US007499665B2

(12) United States Patent
Kuma et al.

(10) Patent No.: US 7,499,665 B2
(45) Date of Patent: Mar. 3, 2009

(54) BELT DEVICE INCLUDING AN ANNULAR BELT, AND AN IMAGE FORMING APPARATUS FOR DETECTION OF ROTATIONAL ANGULAR SPEED OR ROTATIONAL ANGULAR DISPLACEMENT

(75) Inventors: Kazuosa Kuma, Kanagawa (JP); Mitsuru Takahashi, Kanagawa (JP); Kazuchika Saeki, Kanagawa (JP); Tsutomu Katoh, Kanagawa (JP); Takeshi Fukao, Kanagawa (JP); Yoshiharu Kishi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 362 days.

(21) Appl. No.: 11/355,880

(22) Filed: Feb. 17, 2006

(65) Prior Publication Data

US 2006/0210324 A1 Sep. 21, 2006

(30) Foreign Application Priority Data

Mar. 18, 2005 (JP) ..... 2005-078561

(51) Int. Cl.
*G03G 15/00* (2006.01)
*G03G 15/01* (2006.01)

(52) U.S. Cl. ..... 399/167; 399/301; 399/302

(58) Field of Classification Search ..... 399/162, 399/165, 167, 301, 302
See application file for complete search history.

(56) References Cited

U.S. PATENT DOCUMENTS

| | | | |
|---|---|---|---|
| 5,442,428 | A | 8/1995 | Takahashi et al. |
| 5,701,566 | A | 12/1997 | Bisaiji et al. |
| 5,870,650 | A | 2/1999 | Takahashi et al. |
| 5,950,062 | A | 9/1999 | Yahata et al. |
| 5,983,060 | A | 11/1999 | Namekata et al. |
| 6,006,062 | A | 12/1999 | Takahashi et al. |
| 6,035,157 | A | 3/2000 | Takahashi et al. |
| 6,223,008 | B1 | 4/2001 | Takahashi et al. |

(Continued)

FOREIGN PATENT DOCUMENTS

JP 2001-141736 5/2001

(Continued)

OTHER PUBLICATIONS

U.S. Appl. No. 11/934,981, filed Nov. 5, 2007, Furuya et al.

(Continued)

*Primary Examiner*—William J Royer
(74) *Attorney, Agent, or Firm*—Oblon, Spivak, McClelland, Maier & Neustadt, P.C.

(57) ABSTRACT

One end of a rotational shaft of a supporting rotational body attached with a rotational member is rotatably supported. The rotational member is sandwiched by a supporting frame that rotatably supports supporting rotational bodies spanned with an annular belt and fixing members fixed to the supporting frame. Thus, the one end of the rotational shaft is supported by the supporting frame and the fixing members at, at least two points. A mark detector is fixed to the fixing members, and the fixing members are fixed to the supporting frame at, at least two points. Accordingly, erroneous detection of a rotational angular speed or a rotational angular displacement of a supporting rotational body due to vibration of the supporting rotational body can be suppressed.

26 Claims, 6 Drawing Sheets

U.S. PATENT DOCUMENTS

| | | | | |
|---|---|---|---|---|
| 6,269,228 | B1 | 7/2001 | Kayahara et al. | |
| 6,336,025 | B1 | 1/2002 | Saeki | |
| 6,445,900 | B2 | 9/2002 | Fukao et al. | |
| 6,505,024 | B2 | 1/2003 | Kayahara et al. | |
| RE38,206 | E | 7/2003 | Bisaiji et al. | |
| 6,611,672 | B2 | 8/2003 | Aoki et al. | |
| 6,618,565 | B2 | 9/2003 | Tamiya et al. | |
| 6,654,574 | B2 | 11/2003 | Kayahara et al. | |
| 6,690,905 | B2 | 2/2004 | Takahashi et al. | |
| 6,697,595 | B2 | 2/2004 | Kawagoe et al. | |
| 6,701,118 | B2 | 3/2004 | Kayahara et al. | |
| 6,741,821 | B2 | 5/2004 | Sugino et al. | |
| 6,785,500 | B2 | 8/2004 | Takahashi et al. | |
| 6,829,450 | B2 | 12/2004 | Tamiya et al. | |
| 6,834,174 | B2 * | 12/2004 | Imaizumi et al. | 399/162 |
| 6,868,248 | B2 | 3/2005 | Fukao et al. | |
| 6,898,407 | B2 | 5/2005 | Noguchi et al. | |
| 6,901,234 | B2 | 5/2005 | Ogiyama et al. | |
| 6,970,665 | B2 | 11/2005 | Kuma et al. | |
| 6,990,309 | B2 | 1/2006 | Kayahara et al. | |
| 7,251,444 | B2 * | 7/2007 | Matsuda et al. | 399/301 |
| 7,343,119 | B2 * | 3/2008 | Matsuda et al. | 399/167 |
| 2003/0118359 | A1 | 6/2003 | Ogiyama et al. | |
| 2004/0208676 | A1 | 10/2004 | Ishii et al. | |
| 2005/0008393 | A1 | 1/2005 | Kuma et al. | |
| 2005/0047816 | A1 | 3/2005 | Uchida et al. | |
| 2005/0084293 | A1 | 4/2005 | Fukuchi et al. | |
| 2005/0169653 | A1 | 8/2005 | Noguchi et al. | |
| 2005/0169667 | A1 | 8/2005 | Katoh | |

FOREIGN PATENT DOCUMENTS

| | | |
|---|---|---|
| JP | 3545867 | 4/2004 |
| JP | 2004-257403 | 9/2004 |
| JP | 2004-318003 | 11/2004 |
| JP | 2005-10701 | 1/2005 |
| JP | 3690214 | 6/2005 |

OTHER PUBLICATIONS

U.S. Appl. No. 11/943,941, filed Nov. 21, 2007, Katoh et al.
U.S. Appl. No. 11/739,391, filed Apr. 24, 2007, Yokokawa et al.
U.S. Appl. No. 11/608,008, filed Dec. 7, 2006, Katoh et al.
U.S. Appl. No. 11/608,175, filed Dec. 7, 2006, Kuma et al.

* cited by examiner

BELT DEVICE INCLUDING AN ANNULAR BELT, AND AN IMAGE FORMING APPARATUS FOR DETECTION OF ROTATIONAL ANGULAR SPEED OR ROTATIONAL ANGULAR DISPLACEMENT

CROSS-REFERENCE TO RELATED APPLICATIONS

The present document incorporates by reference the entire contents of Japanese priority document, 2005-078561 filed in Japan on Mar. 18, 2005.

BACKGROUND OF THE INVENTION

1. Field of the Invention

The present invention relates to a belt device, and an image forming apparatus including the belt device.

2. Description of the Related Art

A conventional image forming apparatus disclosed in Japanese Patent Application Laid-open No. 2004-318003 is a tandem type image forming apparatus applying an intermediate transfer method. In such method, color toner images formed respectively on four photosensitive elements are transferred onto an intermediate transfer belt in a superimposing manner. The superimposed toner images (a superimposed toner image) are transferred on a recording material. In the tandem type image forming apparatus, unless a surface moving speed of the intermediate transfer belt is constant, positions of respective color toner images are deviated from one another on the intermediate transfer belt. As a result, out of color registration is caused. Even if a driving source generating a rotational driving force transmitted to the intermediate transfer belt is rotated at a fixed angular speed, the surface moving speed of the intermediate transfer belt cannot be kept constant due to various causes. Therefore, feedback control to the driving source is conventionally performed so as to detect a rotational angular speed or a rotational angular displacement of an idle roller supporting the intermediate transfer belt and determine fluctuation of the surface moving speed of the intermediate transfer belt from the detection result to cancel the fluctuation. By conducting such control, fluctuation of the surface moving speed of the intermediate transfer belt can be suppressed, and out of color registration can be prevented accordingly. This arrangement can be similarly applied to a tandem type image forming apparatus applying a direct transfer method in which color toner images respectively formed on four photosensitive elements are transferred onto a recording material on a conveying belt.

To suppress the out of color registration, it is important to detect a rotational angular speed or a rotational angular displacement of a roller (a supporting rotational body) spanned with the intermediate transfer belt or the conveying belt with high accuracy. As a mechanism for the detection, one utilizing a rotary encoder is known. Specifically, a rotational disc (a rotational member) of a rotary encoder is attached to one end of a rotational shaft of a roller to be detected and it is rotated integrally with the rotational shaft of the roller. Plural slits (marks) moving on an orbit according to rotation of the rotational disc integrally with rotation of the rotational shaft are detected by a sensor (a mark detection unit). Based on a result of the detection, a rotational angular speed or a rotational angular displacement is detected.

However, as one of conventional detecting mechanisms utilizing a rotary encoder, a mechanism in which each of two ends of a rotational shaft of a roller is supported by only one supporting frame, and a rotary encoder is attached to one of the ends is known. In such a detecting mechanism, a roller vibrates due to driving of an intermediate transfer belt, a conveying belt, or the like, so that one end of the rotational shaft vibrates about a portion of the rotational shaft. Vibration propagates to the rotational disc and the sensor in the rotary encoder. Normally, timing of transmitted vibration reaching the rotational disc and reaching the sensor differs. Therefore, a relative positional relationship between the rotational disc and the sensor fluctuates. Since the fluctuation of the relative positional relationship appears as a detection error, this detecting mechanism has a problem that detection precision of the rotational angular speed or the rotational angular displacement of the roller is poor. In general, this problem is significant when the time interval of slit detection becomes shorter.

Another conventional detecting mechanism using a rotary encoder is disclosed in Japanese Patent Application Laid-open (JP-A) No. 2001-141736. This detecting mechanism also includes a rotational disc (a rotational member) rotated integrally with a rotational shaft of a roller spanned with an annular belt and a pattern detecting element (a mark detector) detecting a pattern (a mark) formed of plural slits in the rotational disc. The pattern detecting element is fixed on a supporting plate (a fixing member), and the supporting member is attached with a protective cover (a case). The rotational disc has a shaft portion extending in a normal direction to a plate face at a rotational central portion thereof, and the shaft portion is supported by both of the supporting plate and the protective cover. A fitting hole press-fitted with the rotational shaft of the roller is formed in the shaft portion. The rotary encoder is unitized so as to cover the pattern detecting element and the rotational disc using the supporting plate and the protective cover. When the rotary encoder is attached to the rotational shaft of the roller, the rotational shaft of the roller is press-fitted into the fitting hole of the shaft portion of the rotational disc. The supporting plate of the rotary encoder is fixed to a supporting frame that rotatably supports the rotational shaft by screws. One end of the rotational shaft attached with the rotary encoder is supported at three points by the supporting frame, and the supporting plate and the protective cover fixed to the supporting frame. Therefore, even if the roller vibrates due to driving of the intermediate transfer belt, the conveying belt, or the like, vibration of the rotational shaft supported by the supporting frame is suppressed compared to the case in which one end of the rotational shaft is supported at only one point by the supporting frame.

However, the detecting mechanism described in JP-A No. 2001-141736 has such a configuration that the supporting plate is fixed to the supporting frame at only one point on the supporting frame different from a portion thereon supporting the rotational shaft to facilitate assembling of the rotary encoder to the roller rotational shaft. Therefore, when the roller vibrates due to belt driving or the like, the supporting plate vibrates about a fixing portion of the supporting plate to the supporting frame due to the vibration. The vibration is propagated to the rotational disk and the sensor in the rotary encoder. Since a difference occurs between timings at which the vibration thus propagated reaches the rotational disc and the sensor, respectively, a relative positional relationship between the rotational disc and the sensor fluctuates. As a result, the fluctuation of the relative positional relationship appears as a detection error of the sensor like the conventional detecting mechanism where one end of the rotational shaft is supported at only one point of the supporting frame. Therefore, the rotational angular speed or the rotational angular displacement cannot be detected with high accuracy. In general, this problem is significant when the time interval of slit detection becomes shorter.

Such problem is not limited to a case of an image forming apparatus, and occurs in a general detection of a rotational angular speed or a rotational angular displacement of a supporting rotational body spanned with an annular belt.

SUMMARY OF THE INVENTION

It is an object of the present invention to at least solve the problems in the conventional technology.

A belt device according to one aspect of the present invention includes an annular belt spanned around at least two supporting rotational bodies; a supporting frame configured to rotatably support the supporting rotational bodies; a rotational member attached to one end of a rotational shaft of one of the supporting rotational bodies, having a plurality of marks arranged thereon, and configured to rotate integrally with the rotational shaft such that the marks are moved on a fixed orbit; a mark detector configured to detect the marks at a predetermined point on the fixed orbit; and a fixing member fixed to the supporting frame at, at least two points. The mark detector is fixed to the fixing member, and the rotational member is rotatably supported at the one end with the supporting frame and the fixing member such that the rotational member is sandwiched between the supporting frame and the fixing member.

A belt device according to another aspect of the present invention is attachable to and detachable from an apparatus. The belt device includes an annular belt spanned around at least two supporting rotational bodies; a supporting frame configured to rotatably support one of the supporting rotational bodies; a rotational member attached to one end of a rotational shaft of another of the supporting rotational bodies that is not supported by the supporting frame, the rotational member having a plurality of marks arranged thereon, and configured to rotate integrally with the rotational shaft such that the marks are moved on an orbit; a mark detector configured to detect the marks; a positioning supporting member configured to rotatably support the other of the supporting rotational bodies, and to switch a position of the other of the supporting rotational body between a position for applying tension to the annular belt, and a position for removing the tension from the annular belt; and a fixing member fixed to the positioning supporting member at, at least two portions. The positioning supporting member is supported by the supporting frame. The mark detector is fixed to the fixing member. The other of the supporting rotational bodies is rotatably supported at the one end with the positioning supporting member and the fixing member such that the rotational member is sandwiched between the positioning supporting member and the fixing member.

An image forming apparatus according to still another aspect of the present invention includes a belt device according to the above aspect; a controller configured to control a surface moving speed of the annular belt based on a result of detection by the mark detector; and an image forming unit configured to form an image on the annular belt.

An image forming apparatus according to still another aspect of the present invention includes a belt device according to the above aspect; a controller configured to control a surface moving speed of the annular belt based on a result of detection by the mark detector; and an image forming unit configured to form an image on a transfer sheet conveyed by the annular belt.

The other objects, features, and advantages of the present invention are specifically set forth in or will become apparent from the following detailed description of the invention when read in conjunction with the accompanying drawings.

DETAILED DESCRIPTION OF THE PREFERRED EMBODIMENTS

Exemplary embodiments according to the present invention will be explained in detail below with reference to the accompanying drawings.

Figure 2:
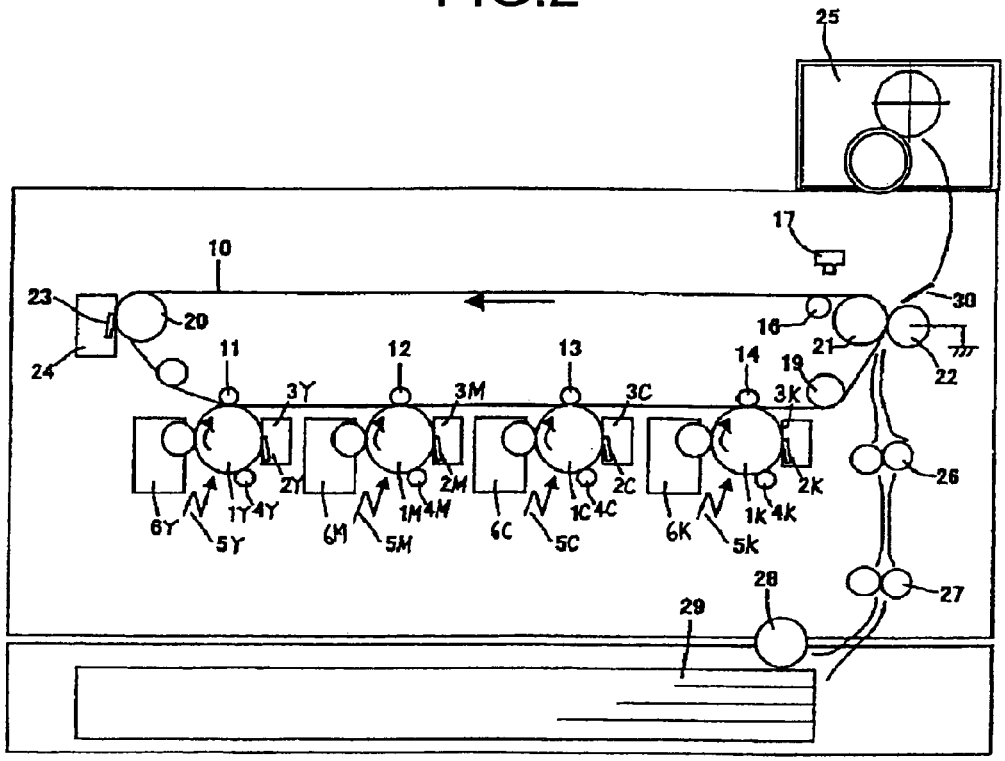
FIG. 2 is a schematic diagram of the printer.

FIG. 2 is a schematic diagram of a printer as an image forming apparatus according to a first embodiment of the present invention. The printer is a tandem type image forming apparatus applying an intermediate transfer method and an electrophotographic method. The printer includes four photosensitive drums each serving as a latent image carrier.

The printer includes a tandem image forming unit, serving as an image forming unit, just below an intermediate transfer belt 10. The tandem image forming unit includes four photosensitive drums 1Y, 1C, 1M, and 1K. Respective reference characters Y, C, M, and K denote yellow, cyan, magenta, and black respectively. The photosensitive drums 1Y, 1C, 1M, and 1K have rotational shafts disposed to extend horizontally and in a direction pointing toward a front side and a rear side of an apparatus, which is a direction normal to drawing paper of FIG. 2. The respective rotational shafts are arranged on the same horizontal plane and in parallel with each other. According to the first embodiment, the respective photosensitive drums 1Y, 1C, 1M, and 1K are set to be rotationally driven at a circumferential speed of 150 mm/sec in a direction of arrow shown in FIG. 2.

The image forming unit includes chargers 4Y, 4C, 4M, and 4K serving as charging units for charging surfaces of the photosensitive drums 1Y, 1C, 1M, and 1K evenly. Each charger is a charging unit of a contact type where a charging roller rotated according to rotation of a surface of the photosensitive drum is caused to contact with the photosensitive drum to charge the same. The charging units may be of a non-contact type. According to the first embodiment, the respective photosensitive drums 1Y, 1C, 1M, and 1K are applied with alternating current (AC) bias and direct current (DC) bias so that they are charged such that their surface potentials reach −500 volts (V) evenly.

An exposing device (not shown) serving as a latent image forming unit is provided below the photosensitive drums 1Y, 1C, 1M, and 1K. The exposing device irradiates lights 5Y, 5C, 5M, and 5K corresponding to image information elements to the photosensitive drums 1Y, 1C, 1M, and 1K to form respective color latent images on the respective drums. As the exposing device, a laser beam scanner using laser diodes may be used.

Developing devices 6Y, 6C, 6M, and 6K, serving as developing units, which develop electrostatic latent images on the respective photosensitive drums 1Y, 1C, 1M, and 1K are arranged around the respective photosensitive drums 1Y, 1C, 1M, and 1K. According to the first embodiment, a developing device performing a two-component non-contacting development is adopted. Specifically, predetermined developing biases are applied from a high voltage power source (not shown) to the developing rollers serving as developer carriers in the respective developing devices 6Y, 6C, 6M, and 6K so that toners in the developers carried on the developing rollers are moved to latent images on the photosensitive drums 1Y, 1C, 1M, and 1K to be adhered to the latent images. Thereby, toner images corresponding to the latent images are formed on the photosensitive drums 1Y, 1C, 1M, and 1K.

Figure 3:
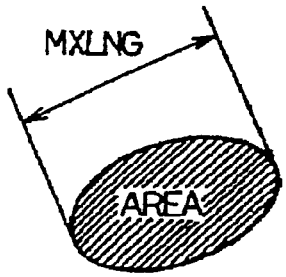
FIG. 3 is a schematic diagram of a toner shape for explaining a shape factor SF-1.
Figure 4:
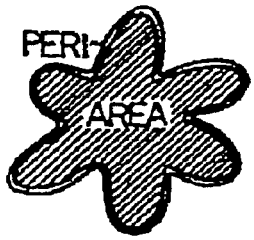
FIG. 4 is a schematic diagram of a toner shape for explaining a shape factor SF-2.

The toner particles used in the first embodiment are polymer toner particles produced by a polymerization process, where shapes of the toner particles are in a range of 100 to 180 regarding a shape factor SF-1 and are in a range of 100 to 180 regarding a shape factor SF-2. FIG. 3 is a schematic diagram of a toner shape for explaining the shape factor SF-1. FIG. 4 is schematic diagram of a toner shape for explaining the shape factor SF-2.

The shape factor SF-1 indicates a ratio of roundness of toner shape and it is expressed by the following Equation 1. That is, the shape factor SF-1 is a value obtained by dividing a square of the maximum length MXLNG of a projection plane of a toner particle projected on a two-dimensional plane by an area AREA of the projection plane and multiplying the divided value by 100×π/4. When the value of the shape factor SF-1 is 100, the toner shape shows a true sphere, and it shows an indefinite shape deviated from a true sphere according to increase in value of the shape factor SF-1.

$$SF\text{-}1=\{(\mathrm{MXLNG})^2/\mathrm{AREA}\}\times(100\times\pi/4) \quad (1)$$

The shape factor SF-2 indicates a ratio of undulation or roughness of a toner shape and it is expressed by the following Equation 2. That is, the shape factor SF-2 is a value obtained by dividing a square of a peripheral length PERI of a projection plane of a toner particle projected on a two-dimensional plane by an area AREA of the projection plane and multiplying the divided value by 100'p/4. When the value of the shape factor SF-2 is 100, the toner shape shows that a toner surface does not include undulation, and undulation on a toner surface becomes more significant when the value of the shape factor SF-2 becomes larger.

$$\mathrm{SF\text{-}2}=\{(\mathrm{PERI})^2/\mathrm{AREA}\}\times(100\times\pi/4) \quad (2)$$

Each of the shape factors SF-1 and SF-2 is calculated by photographing a toner particle using a scanning type electronic microscope (S-800 manufactured by Hitachi, Ltd.) and introducing the photographed image to an image analyzer (LUSEX3 manufactured by NIRECO CORPORATION) to analyze the same.

When a toner shape approximates to a true sphere, a contacting area between toner particles becomes small like a point contact, so that adhesion force between the toner particles becomes weak. As a result, flowability of toner particle becomes high. Furthermore, when a toner shape approximates to a true sphere, a contacting area between toner particles and a surface of a photosensitive drum also becomes small like a point contact, so that adhesion force of toner particles to a surface of a photosensitive drum becomes weak. Since flowability of toner particle becomes high and adhesion force of toner particles to a surface of a photosensitive drum becomes weak, a transfer ratio of toner particles to the intermediate transfer belt becomes high. When either of the shape factors SF-1 and SF-2 exceeds 180, the transfer ratio lowers undesirably.

Respective color toner images on the respective photosensitive drums 1Y, 1C, 1M, and 1K developed by the developing devices 6Y, 6C, 6M, and 6K are primarily transferred on the intermediate transfer belt 10 in a superimposing manner. The intermediate transfer belt 10 is spanned around supporting rotating bodies such as a secondary transfer bias roller 21 constituting a secondary transfer unit, primary transfer bias rollers 11, 12, 13, and 14 constituting a primary transfer unit, a sensor-opposing roller 16, a secondary transfer inlet roller 19, and a belt cleaning opposing roller 20. According to the first embodiment a rotational driving force from a driving source (not shown) is transmitted to the secondary transfer bias roller 21, and the intermediate transfer belt 10 is endlessly moved in a direction of an arrow in FIG. 2 according to the rotational driving of the secondary transfer bias roller 21. That is, in the first embodiment, the secondary transfer bias roller 21 serves as a driving supporting rotational body for the intermediate transfer belt 10. Another supporting rotational body can be also used as the driving supporting rotational body.

The intermediate transfer belt 10 can be an endless belt formed with a resin film in which an electrical conductive material, such as carbon black, is dispersed into, for example, polyvinylidene fluoride (PVDF), ethylene-tetrafluoroethylene copolymer (ETFE), polyimide (PI), or polycarbonate (PC).

A belt having elasticity can be used instead of such a resin film belt. As material for the intermediate transfer belt 10 having elasticity, rubber, elastomer, resin, and the like can be used. As for rubber and elastomer, one or more types of rubbers and elastomers selected from among natural rubber, epichiorohydrine rubber, acrylic rubber, silicone rubber, fluorine rubber, polysulfide rubber, polynorbomene rubber, isoprene rubber, styrene-butadiene rubber, butadiene rubber, butyl rubber, ethylene-propylene rubber, ethylene-propylene copolymer, chloroprene rubber, chlorosulfonated polyethylene, chlorinated polyethylene, acrylonitrile butadiene rubber, urethane rubber, syndiotactic 1,2-polybutadiene, hydrogenated nitrile rubber, and thermoplastic elastomers (based on, for example, polystyrene, polyolefin, polyvinyl chloride, polyurethane, polyamide, polyester, and fluorine resin) can be used. Furthermore, as for resin, one or more types of resins selected from among phenol resin, epoxy resin, polyester resin, polyester polyurethane resin, polyethylene, polypropylene, polybutadiene, polyvinylidene chloride, ionomer resin, polyurethane resin, silicone resin, fluorine resin, ketone resin, styrene resins (styrene or a monopolymer or a copolymer including a styrene substituent) such as polystyrene, chloropolystyrene, poly-α-methylstyrene, styrene-butadiene copolymer, styrene-vinyl chloride copolymer, styrene-vinyl acetate copolymer, styrene-maleic acid copolymer, styrene-acrylate copolymer (styrene-methyl acrylate copolymer, styrene-ethyl acrylate copolymer, styrene-butyl acrylate copolymer, styrene-octyl acrylate copolymer, and styrene-phenyl acrylate copolymer), styrene-methacrylate copolymer (styrene-methyl methacrylate copolymer, styrene-ethyl methacrylate copolymer and styrene-phenyl methacrylate copolymer), styrene-a-methyl chioroacrylate copolymer and styrene acrylonitrile-acrylate copolymer, methyl methacrylate resin, butyl methacrylate resin, ethyl acrylate resin, butyl acrylate resin, modified acrylic resins (silicone modified acrylic resin, vinyl chloride resin modified acrylic resin and acryl/urethane resin, and the like), vinyl chloride resin, styrene-vinyl acetate copolymer, vinyl chloride-vinyl acetate copolymer, rosin modified maleic acid resin, ethylene-ethyl acrylate copolymer, xylene resin, polyvinylbutyral resin, polyamide resin, and modified polyphenylene oxide resin can be used.

To control the resistance of the intermediate transfer belt 10, a conductant agent can be added as mentioned above. As for the conductant agent, one or more types of conductant agents selected from among metallic dusts such as carbon, aluminium, and nickel; metal oxides such as titanium oxide; and conductive polymer compounds such as poly methyl methacrylate containing a quaternary ammonium salt, polyvinyl aniline, polyvinyl pyrrole, polydiacetylene, polyethyleneimine, a polymer compound containing boron, and polypyrrole.

It is preferable for prevention of contamination (bleed) of the photosensitive drums 1Y, 1C, 1M, and 1K, prevention of toner fixing (filming) on the intermediate transfer belt 10, charge control to toner, adjustment of surface resistance of the intermediate transfer belt 10, control of frictional coefficient, and the like that a surface coating layer made of any of various resins is formed on a surface of the intermediate transfer belt 10. As the resin forming the surface coating layer, any resin appropriately selected from known materials can be used. Specific examples of the resin include fluorine resin, urethane resin, polycarbonate resin, polyvinyl acetal resin, acrylic resin, silicone resin, polyester resin, amino resin, epoxy resin, polyamide resin, phenol resin, alkyd resin, melamine resin, ketone resin, ionomer resin, polybutadiene resin, chlorinated polyethylene, vinylidene chloride resin , acryl/urethane resin, acryl/silicone resin, ethylene, vinyl acetate resin, vinyl chloride/vinyl acetate resin, styrene/acrylic resin, styrene/butadiene resin, styrene/maleic acid resin, and ethylene/acrylic resin. They can be used in a mixture of one or more types.

The intermediate transfer belt 10 according to the first embodiment has a single layer structure where carbon black is added in PI, and a thickness thereof is adjusted to 100 micrometers.

It is desirable that the intermediate transfer belt 10 has a volume resistivity in a range of $10^7$ to $10^{12}$ Ω·cm and a surface resistivity in a range of $10^9$ to $10^{15}$ Ω/□. When the volume resistivity and the surface resistivity of the intermediate transfer belt 10 exceed these ranges, a bias value required for transfer becomes high, which results in increase in power cost. Furthermore, since a charge potential on a surface of the intermediate transfer belt 10 becomes high due to discharging generated in a transfer step, a recording material peeling-off step, or the like, and self-discharging becomes difficult, it is necessary to provide an electricity remover for the intermediate transfer belt 10, which results in increase in cost. On the other hand, when the volume resistivity and the surface resistivity of the intermediate transfer belt 10 lowers below the ranges, decay of charge potential of the intermediate transfer belt 10 is accelerated. Therefore, this phenomenon is advantageous for electricity removing due to self discharging, however, since a current at a time of transfer flows in a direction of a belt face, toner scattering occurs and image blur occurs, which results in image degradation.

A resistance value of the intermediate transfer belt 10 is a value measured according to the following measuring method. That is, first, a probe (an inside electrode diameter of 50 millimeters (mm) and a ring electrode inner diameter of 60 mm: in conformity with JIS-K6911) is connected to a digital super high resistance fine current ammeter (R8340A manufactured by Advantest Corporation). A voltage of 1000 V is applied to obverse and reverse faces of the intermediate transfer belt 10 and measurement is performed as discharge for 5 seconds at a measuring time of the volume resistivity while a voltage of 500 V is applied to the obverse and reverse faces thereof and measurement is performed as discharge for 10 seconds at a measuring time of the surface resistivity. An environment during the measurement is fixed to a temperature of 22° C. and moisture of 55%.

A primary bias voltage is applied to four primary transfer bias rollers 11, 12, 13, and 14 spanned with the intermediate transfer belt 10 from a high voltage power source (not shown). Thereby, a primary transfer is performed in primary transfer regions between belt portions of the intermediate transfer belt 10 wound on the primary transfer bias rollers 11, 12, 13, and 14 and the photosensitive drums 1Y, 1C, 1M, and 1K. Since the respective primary transfer bias rollers 11, 12, 13, and 14 press the intermediate transfer belt 10 to form nips between the intermediate transfer belt 10 and the photosensitive drums 1Y, 1C, 1M, and 1K, they have elastic layers.

Photosensitive element cleaning units 3Y, 3C, 3M, and 3K serving as latent image carrier cleaning units for removing residual toners on the photosensitive drums 1Y, 1C, 1M, and 1K after primary transfer are provided around the respective photosensitive drums 1Y, 1C, 1M, and 1K. Each photosensitive element cleaning unit 3Y, 3C, 3M, and 3K includes a cleaning blade 2Y, 2C, 2M, and 2K abutting on a surface of the photosensitive drums 1Y, 1C, 1M, and 1K, and cleaning is performed by scraping residual toner on the surface of the photosensitive drums 1Y, 1C, 1M, and 1K after transfer.

A toner image transferred on the intermediate transfer belt 10 is secondarily transferred on a recording material 29 conveyed to a secondary transfer region between a belt portion of the intermediate transfer belt 10 wound on the secondary transfer bias roller 21 and a secondary transfer opposing roller 22 in the secondary transfer region. The secondary transfer opposing roller 22 is grounded, and a high voltage power source (not shown) is connected to the secondary transfer bias roller 21. According to the first embodiment, a secondary transfer bias of −2000 V is applied to the secondary transfer bias roller 21. The secondary transfer opposing roller 22 is constituted by coating an elastic member such as urethane adjusted to a resistance value in a range of $10^6$ to $10^{10}$Ω using electrically conductive material on a core made of metal such as SUS. When the resistance value of the secondary transfer opposing roller 22 exceeds the range, it becomes difficult to obtain a sufficient transfer current flow, so that a higher transfer bias is required for obtaining a necessary transfer performance, which results in an increase in power cost. Since application of a higher transfer bias is required, discharging occurs at gaps before and after the nip in the secondary transfer region due to the higher bias, so that image degradation such as spotting can occur due to discharging on a halftone image. This phenomenon becomes significant in a low temperature and low moisture environment (for example, a temperature is 10° C. and moisture is 15%). On the contrary, when the resistance value of the secondary transfer opposing roller 22 lowers below the range, high transfer performance cannot be kept both in a stacking portion that includes stacking of two or more color toners, and in a non-stacking portion that does not include toner stacking. This is because, since a resistance value of the secondary transfer opposing roller 22 is low, when a relatively low transfer bias where a transfer current sufficient to transfer toner at the non-stacking portion flows is set, it is insufficient for transferring toner at the stacking portion, while a transfer current becomes excessive for toner at the non-stacking portion to reduce a transfer efficiency when a relatively high transfer bias where a transfer current sufficient to transfer toner at the stacking portion flows is set. The resistance value of the secondary transfer opposing roller 22 is calculated from a value of a current flowing when a voltage of 1000 V is applied between the metal core of the secondary transfer opposing roller 22 and a conductive metal plate under a state where the secondary transfer opposing roller 22 is mounted on the conductive metal plate and a load of 4.9 Newtons for each side (a total of both sides is 9.8 Newtons) is applied to each of both ends of the metal core. An environment for the measurement is fixed to a temperature of 22° C. and moisture of 55%. According to the first embodiment, the resistance value of the secondary transfer opposing roller 22 is adjusted to be 7.8 Log Ω.

It is desirable that resistance values of the primary transfer bias rollers 11, 12, 13, and 14 are also set in a range similar to that in the secondary transfer opposing roller 22 for the same reason as the secondary transfer opposing roller 22. According to the first embodiment, the resistance value of each of the primary transfer bias rollers 11, 12, 13, and 14 is adjusted to be 7.0 Log Ω. A method for measuring the resistance value is similar to that for the secondary transfer opposing roller 22.

The recording material 29 is fed to the secondary transfer region by a pickup roller 28, a fed paper conveying roller 27, and a registration roller 26 at a timing at which a leading edge of the toner image on the intermediate transfer belt 10 advances to the secondary transfer region. The recording material 29 on which the toner image has been transferred in the secondary transfer region separates from the intermediate transfer belt 10 due to a curvature of the secondary transfer opposing roller 22 and a predetermined bias applied by a separating unit 30 to be fed to a fusing device 25 serving as a fusing unit. The toner image on the recording material 29 is fused on the recording material 29 by the fusing device 25, and it is then discharged outside the apparatus.

A belt cleaning device 24 serving as an intermediate transfer member cleaning unit for removing residual toner on the intermediate transfer belt 10 after secondary transfer is provided at an opposing position to a belt portion of the intermediate transfer belt 10 wound on the belt cleaning opposing roller 20. The belt cleaning device 24 includes a cleaning blade 23 abutting on a surface of the intermediate transfer belt 10, so that cleaning is performed by scrapping post-transferred residual toner on the surface of the intermediate transfer belt 10 by the cleaning blade 23.

According to the first embodiment, a process speed at a fusing time is changed according to a kind of the recording material 29. Specifically, when a recording material having a ream weight of 110 kilograms or more is used, the process speed is set to a half of the process speed at an ordinary time. Thereby, a recording material can take twice a time period taken at an ordinary time to pass through a fusing nip constituted by a fusing roller pair, so that fusing stability to a toner image can be secured. On the other hand, when a process speed at a fusing time is set to half of the process speed at the ordinary time (the ordinary process speed), the secondary transfer step for transferring a toner image on the intermediate transfer belt 10 on the recording material 29 is also performed at a half speed of the process speed at the ordinary time. Therefore, when the process speed at the fusing time is set to half of the ordinary process speed, a cardboard mode is applied as a value of the secondary transfer bias applied to the secondary transfer bias roller 21. According to the first embodiment, the kind of the recording material 29 can be designated at the operation unit, where there are a standard paper mode corresponding to the standard process speed, and a cardboard mode corresponding to a half of the standard process speed, and an overhead projector (OHP) mode. The term "ream" is a unit for expressing 1000 sheets finished to the same standard size collectively. In the case of a 4/6 size sheet, 4/6 is defined as a standard size, and a weight of 1000 sheets of the 4/6 size is called "ream weight", where a unit is expressed as "kg".

In the first embodiment, image forming can be performed in any of a single color mode where an image of one of yellow, magenta, cyan, and black is formed, a two color mode where images of two of yellow, magenta, cyan, and black are formed in a superimposing manner, a three color mode where images of three of yellow, magenta, cyan, and black are formed in a superimposing manner, and a full color mode where images of all of yellow, magenta, cyan, and black are formed in a superimposing manner. One of the modes can be designated according to operation on an operation unit performed by an operator.

The first embodiment includes an out-of-color registration correcting control mode for correcting a transfer position deviation among respective colors and an image density adjusting control mode for correcting densities of respective colors. The modes can be performed using a reflecting sensor 17 arranged at a position opposed to a belt portion of the intermediate transfer belt 10 wound on the sensor opposing roller 16 while image forming is not being performed.

Specifically, in the out-of-color registration correcting control mode, toner patterns for out-of-color registration correction are first formed on the respective photosensitive drums 1Y, 1C, 1M, and 1K, and the respective color toner patterns are transferred on the intermediate transfer belt 10. Thereafter, positions of the toner patterns are determined from detecting timings of the reflecting sensor 17 and a relative positional deviation amount among respective color toner patterns is calculated. An exposing time in the exposing device is corrected so as to cancel the relative positional deviation amount.

In the image density adjusting control mode, toner patterns for image density adjustment are first formed on the respective photosensitive drums 1Y, 1C, 1M, and 1K, and the respective color toner patterns are transferred on the intermediate transfer belt 10. Thereafter, densities of the respective toner patterns are determined from amounts of light receptions on the reflecting sensor 17, and charging biases of the chargers 4Y, 4C, 4M, and 4K or developing bias of the developing devices 6Y, 6C, 6M, and 6K are corrected such that densities of the respective colors reaches target densities.

The processes of the out-of-color registration correcting control mode and the image density adjusting control mode are not limited to the above, and other processes can be adopted in these modes.

Figure 5:
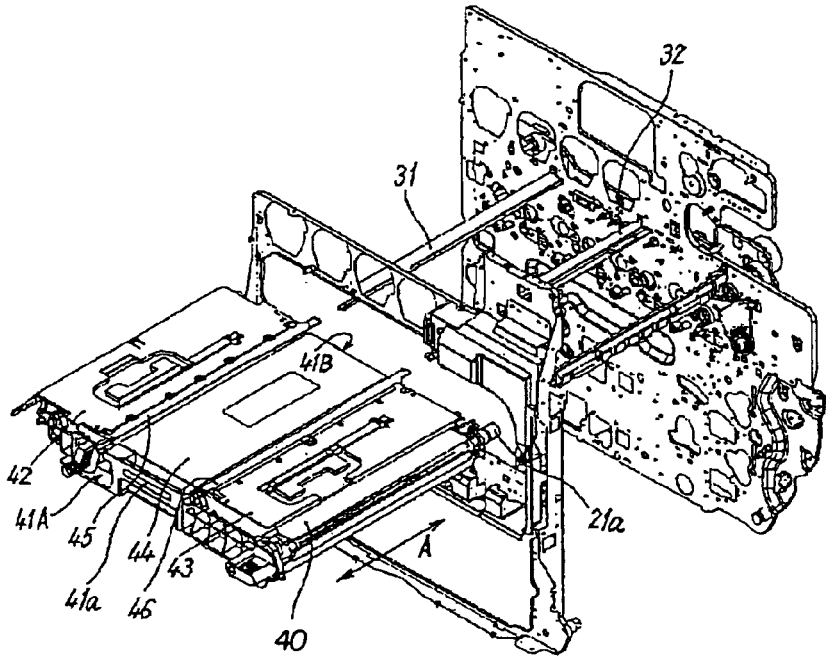
FIG. 5 is a schematic diagram of a main unit of the printer and an intermediate transfer unit.

FIG. 5 is an explanatory diagram of an appearance of the intermediate transfer unit and an internal configuration of a printer main unit in/from which the intermediate transfer unit is inserted/removed.

According to the first embodiment, an intermediate transfer unit 40 includes the intermediate transfer belt 10, and supporting rotational bodies such as the secondary transfer bias roller 21, the first transfer bias rollers 11, 12, 13, and 14, the sensor opposing roller 16, the secondary transfer inlet roller 19, and the belt cleaning opposing roller 20 that are spanned with the intermediate transfer belt 10, and it can be inserted into and removed from the printer main unit. The intermediate transfer unit 40 can be inserted into and removed from the printer main unit from a front side of the printer main unit in a direction of arrow A in FIG. 5 approximately horizontally. Hereinafter, the direction of arrow A is defined as front and rear directions.

As shown in FIG. 5, the respective supporting rotational bodies 11, 12, 13, 14, 16, 19, 20, and 21 are arranged such that their axial directions conform to the front and rear directions of the intermediate transfer unit 40. The respective supporting rotational bodies are rotatably supported at their both ends in the axial directions by inner wall faces of both supporting frames 41A and 41B of the intermediate transfer unit 40 in the front and rear directions. A shaft end 21*a*, on a side of the printer main unit, of the secondary transfer bias roller 21 of the supporting rotational bodies extends outside the intermediate transfer unit 40. The shaft end 21*a* is coupled to a driving shaft connected to a power source (not shown) on the side of the printer main unit, when the intermediate transfer unit 40 is inserted into the printer main unit.

The intermediate transfer unit 40 directed vertically upwardly when the intermediate transfer unit 40 is inserted into and removed from the printer main unit includes cover members 42, 43, and 44 that cover an outer peripheral portion of the intermediate transfer belt 10. According to the first embodiment, the cover members 42, 43, and 44 cover an outer peripheral face full width over a widthwise direction (front and back directions) of the intermediate transfer belt 10. However, they can cover an outer peripheral face of a portion of the intermediate transfer belt 10 in the widthwise direction thereof. The cover members 42, 43, and 44 are provided for preventing unnecessarily adhered material (for example, metal powder generated inside the printer main unit or the like) from adhering on an outer peripheral face of the intermediate transfer belt 10. Therefore, it is desirable that the cover members 42, 43, and 44 cover the whole outer peripheral face of the intermediate transfer belt 10. However, when the cover members 42, 43, and 44 are constituted to cover the whole peripheral face region of the intermediate transfer belt 10, processing in various devices such as the photosensitive drums 1Y, 1C, 1M, and 1K, the secondary transfer opposing roller 22, the reflecting sensor 17, and the belt cleaning device 24, which perform various processing between the outer peripheral face of the intermediate transfer belt 10 and the various devices when the intermediate transfer belt 10 is inserted into the printer main unit to be set therein, are blocked by the cover members 42, 43, and 44. Therefore, in this case, it is necessary to provide a mechanism for retracting the obstructive cover members 42, 43, and 44 to a non-obstructive position when the intermediate transfer belt 10 is set to the printer main unit. Therefore, similarly to the first embodiment, it is desirable that guide members are provided at only positions where processing in the devices on the printer main unit side, which perform various processing between the outer peripheral face of the intermediate transfer belt 10 and the various devices are not blocked. Specifically, according to the first embodiment, the whole region of the outer peripheral face of the intermediate transfer belt 10 that is oriented vertically upwardly when the intermediate transfer unit 40 is inserted into and removed from the printer main unit and that is positioned between the belt portion of the intermediate transfer belt 10 opposed to the reflecting sensor 17 and a belt portion of the intermediate transfer belt 10 opposed to the cleaning blade 23 of the belt cleaning device 24 is covered by the cover member 42, 43, and 44. Since the adhered materials often drop due to gravity, similarly to the first embodiment, it is desirable that the cover members 42, 43, and 44 are provided to cover the outer peripheral face portion of the intermediate transfer belt 10 oriented vertically upwardly when the intermediate transfer unit 10 is set to the printer main unit.

In the intermediate transfer unit 40, two cover members 42 and 43 include to-be-guided members 45 and 46 extending along end sides thereof opposed to each other. Material for the to-be-guided member 45 and 46 can be resin or metal, however, the to-be-guided members 45 and 46 are formed integrally with the respective cover members 42 and 43 using the same material, and the material thereof is polystyrene (PS). When the intermediate transfer unit 40 is inserted or removed, the to-be-guided members 45 and 46 are fitted to guide rails 31 and 32 made of metal serving as guide members provided on the printer main unit to guide the intermediate transfer unit 40. According to the first embodiment, the guide rails 31 and 32 support the intermediate transfer unit 40 via the to-be-guided members 45 and 46 when the intermediate transfer unit 40 is inserted into and removed from the printer main unit.

As a characteristic part of the present invention, a mechanism for detecting a rotational angular speed or a rotational angular displacement in the secondary transfer inlet roller 19 of the intermediate transfer belt 10 that will be explained next.

Figure 6:
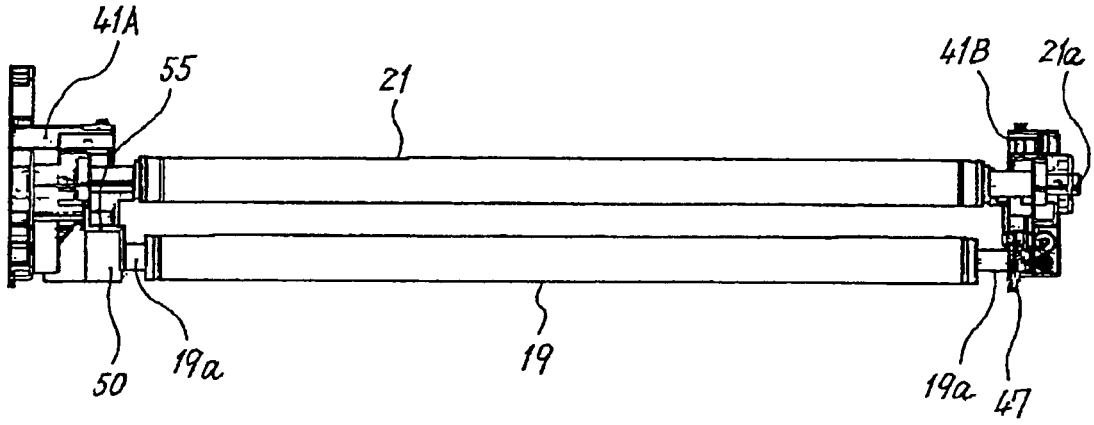
FIG. 6 is a schematic diagram of a secondary transfer bias roller and a secondary transfer inlet roller in the printer.

FIG. 6 a schematic diagram of the secondary transfer bias roller 21 and the secondary transfer inlet roller 19 viewed from the secondary transfer region side. An end portion of a rotational shaft 19*a* of the secondary transfer inlet roller 19 positioned on a back side of the printer main unit is rotatably supported by the supporting frame 41B via an E ring 47, while an end thereof positioned on a front side of the printer main unit is rotatably supported by a bearing 41*a* (FIG. 5) of the supporting frame 41A described later. The end portion of the rotational shaft 19*a* of the secondary transfer inlet roller 19 positioned at the front side is attached with a rotary encoder 50.

The secondary transfer inlet roller 19 including the rotary encoder 50 vibrates due to driving of the intermediate transfer belt 10 or the like. When the vibration is propagated to the rotary encoder 50 by the rotational shaft 19*a* of the secondary transfer inlet roller 19, fluctuation occurs in a relative positional relationship between the rotational disk of the rotary encoder 50 and the sensor so that an erroneous detection in the sensor occurs. When the erroneous detection in the sensor occurs, for example, even if the rotational shaft 19*a* of the secondary transfer inlet roller 19 is rotating at a fixed rotational angular speed, detection is made as if the rotational angular speed of the rotational shaft 19*a* is fluctuating, so that accurate feedback control described later cannot be made. Therefore, the first embodiment adopts the following configuration.

Figure 1:
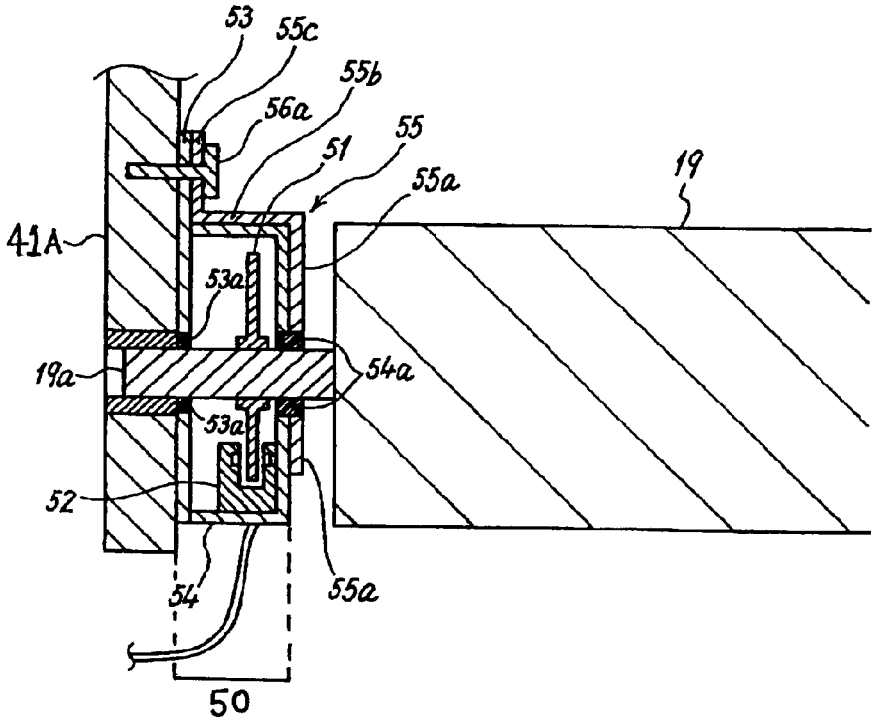
FIG. 1 is a cross-section of a rotary encoder in a printer according to a first embodiment of the present invention.

FIG. 1 is a cross-section of the rotary encoder 50, taken along a direction of the rotational shaft 19*a* (hereinafter, "roller shaft direction") of the secondary transfer inlet roller 19. The rotary encoder 50 includes a rotational disc 51, serving as a rotational member, fixed to the rotational shaft 19*a* of the secondary transfer inlet roller 19 to be rotated together therewith, and a sensor 52 serving as a mark detector that detects slits (not shown) that are a plurality of marks formed on an orbit about the center of the rotational disc 51 at equal intervals.

It is desirable that the rotational disc 51 is formed integrally with the rotational shaft 19*a*, or it is attached to the rotational shaft 19*a* by adhesive or a screw to be unitized to the same. This is because, when the rotational disc 51 is attached to the rotational shaft 19*a* utilizing press-fitting or the like, a clearance in the order to micron meter at the fitted portion causes backlash, and the rotational disc 51 vibrates, so that fluctuation can occur in the relative positional relationship between the rotational shaft 19*a* and the rotational disc 51.

The sensor 52 is an optical sensor of a transmission type. The mark detector 52 is not limited to the optical sensor of a transmission type, however, any optical sensor of a reflection type or a magnetic sensor can also be used if it can detect the marks on the rotational disc 51. The sensor 52 is attached, together with a base plate 53, to an inner wall of a cover member 54 covering the rotational disc 51 and the sensor 52. That is, in the first embodiment, the base plate 53 and the cover member 54 constitute a fixing member by attaching the cover member 54 to the base plate 53 and also function as a case member accommodating the rotational disc 51 and the sensor 52 therein. The base plate 53 and the cover member 54 have bearing units 53*a* and 54*a* constituted by ball bearings that rotatably support the rotational shaft 19*a* of the secondary transfer inlet roller 19. The base plate 53 and the cover member 54 are fixed to the supporting frame 41A by a bracket 55.

Figure 7:
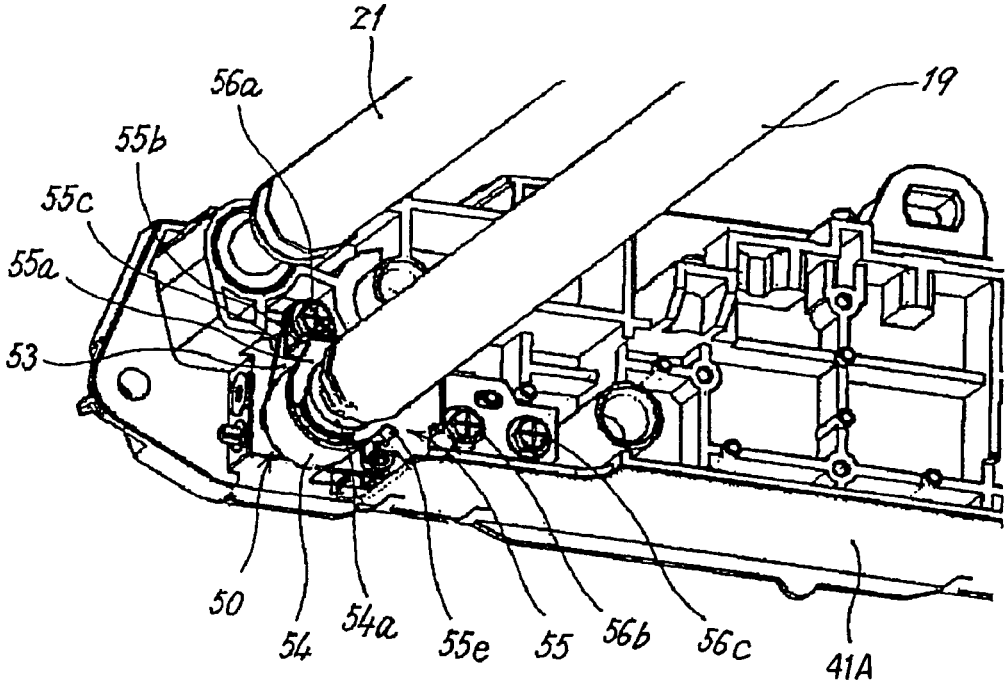
FIG. 7 is an enlarged perspective view of the secondary transfer bias roller and the secondary transfer inlet roller.

FIG. 7 is an enlarged perspective view of the secondary transfer bias roller 21 and the secondary transfer inlet roller 19 on the front side of the printer. The bearing unit 54*a* of the cover member 54 for the rotary encoder 50 projects from an end face of the cover member 54 in the roller shaft direction, as shown in FIG. 7, and a projecting portion thereof is fit into an arcuate Y-shaped portion 55*a* of the bracket 55. The arcuate Y-shaped portion 55*a* is formed integrally with a coupling portion 55*b* extending toward the supporting frame 41A perpendicularly to a face of the arcuate Y-shaped portion 55*a*. The coupling portion 55*b* is formed to have a length approximately equal to that of the rotary encoder 50 in the roller shaft direction, and a face thereof is formed along an outer face shape of the cover member 54 of the rotary encoder 50. An end of the coupling portion 55*b* on the side of the supporting frame 41A is formed integrally with a first screwing portion 55*c* and a second screwing portion extending in a direction perpendicularly to a face of the coupling portion 55*b*, respectively.

A face of the first screwing portion 55*c* of the bracket 55 on the side of the supporting frame 41A is provided so as to overlap with a face of the base plate 53 of the rotary encoder 50. The first screwing portion 55*c* of the bracket 55 and the base plate 53 are fastened together to the supporting frame 41A by a fixing screw 56*a*. The second screwing portion of the bracket 55 is fastened to the supporting frame 41A by two fixing screws 56*b* and 56*c*. The second screwing portion of the bracket 55 has, on a face thereof, a hook portion 55*e* provided to project and serving as a to-be-engaged portion. A projection provided on the base plate 53 of the rotary encoder 50 to serve as an engaging portion (not shown) is fitted into the hook portion 55*e*. Therefore, the base plate 53 of the rotary encoder 50 is fixed to the bracket 55 by fitting thereof into the hook portion 55*e* and fastening thereof together with the first screwing portion 55*c* performed by the fixing screw 56*a*.

The detection result of the sensor 52 in the rotary encoder 50 is transmitted to a controller serving as a control unit (not shown) of the printer. The controller is for controlling drive of a driving source connected to the secondary transfer bias roller 21. The controller sequentially receives the detection results of the sensor 52 in the rotary encoder 50, after the driving source is driven to drive the intermediate transfer belt 10. A rotational angular speed or a rotational angular displacement of the secondary transfer inlet roller 19 can be determined from the detection results, and a surface moving speed of the intermediate transfer belt 10 which the secondary transfer inlet roller 19 rotationally follows can be determined from the rotational angular speed or the rotational angular displacement. Thereby, the controller cancels fluctuation of the surface moving speed of the intermediate transfer belt 10 and conducts feedback control such that the surface moving speed becomes a desired fixed speed.

As a specific feedback control method performed based on the detection results of the sensor 52, known feedback control methods can be widely utilized, and the feedback control method is not particularly limited.

With the configuration described above, according to the first embodiment, the front side end of the rotational shaft 19*a* of the secondary transfer inlet roller 19 fixed with the rotational disc 51 is rotatably supported such that the rotational disc 51 is sandwiched by the supporting frame 41A and the base plate 53 and the cover member 54 fixed thereto by the bracket 55. Thereby, the front side end of the rotational shaft 19*a* of the secondary transfer inlet roller 19 is supported at three points by the supporting frame 41A, the base plate 53, and the cover member 54. Therefore, even if the secondary transfer inlet roller 19 vibrates due to driving of the intermediate transfer belt 10 or the like, fine swinging of the rotational disc 51 and the sensor 52 in the rotary encoder 50 about their supporting portions to the supporting frame 41 is suppressed, as compared with the case that the front side end of the rotational shaft 19*a* is supported at only one point by the supporting frame 41A. As a result, fluctuation of the relative positional relationship between the rotational disc 51 and the sensor 52 due to vibration caused by the swinging is suppressed, and detection error in the sensor 52 is reduced accordingly.

The base plate 53 fixed with the sensor 52 and the cover member 54 are fixed to the bracket 55, and the bracket 55 is fixed at its three points to the supporting frame 41A by fixing screws 56*a*, 56*b*, 56*c*. Thereby, even if the secondary transfer inlet roller 19 vibrates due to driving of the intermediate transfer belt 10 or the like, vibration due to fine swinging of the base plate 53 and the cover member 54 about fixing portions of the base plate 53 and the cover member 54 to the supporting frame 41A is suppressed, as compared with a case that the base plate 53 and the cover member 54 are fixed to the supporting frame 41A at only one point thereof. As a result, fluctuation of the relative positional relationship between the rotational disc 51 and the sensor 52 due to vibration caused by the swinging is suppressed so that detection error in the sensor 52 is reduced.

As described above, according to the first embodiment, since a detection error in the sensor 52 is reduced, erroneous detection of the rotational angular speed or the rotational angular displacement of the secondary transfer inlet roller 19 can be suppressed, so that accurate feedback control can be made.

Figure 8:
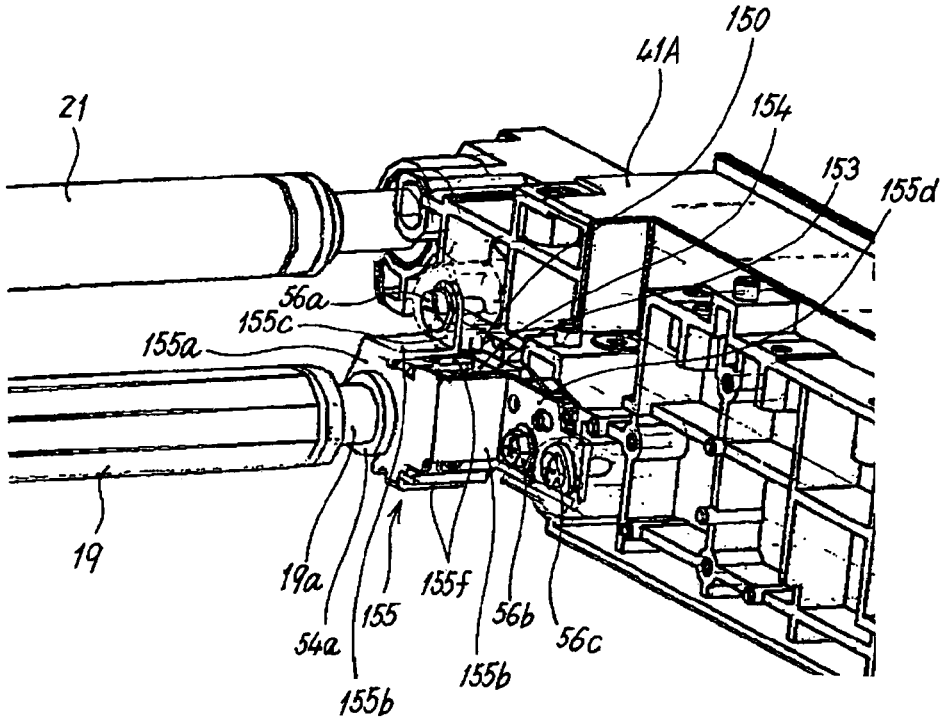
FIG. 8 is an enlarged perspective view of a secondary transfer inlet roller according to a first modification of the present invention.

FIG. 8 is an enlarged perspective view of an end portion of the secondary transfer inlet roller 19 according to a first modification positioned on the front side of the printer. The first modification is different from the first embodiment in a method for fixing a rotary encoder 150 to the supporting frame 41A. Specifically, in the first modification, an outer shape of the rotary encoder 150 formed in an approximately cubic shape by a base plate 153 and a cover member 154, and the rotary encoder 150 is fixed to a bracket 155 by fitting of the rotary encoder 150 into the bracket 155. The bracket 155 is fixed to the supporting frame 41A at three points by screwing fixing screws 56*a*, 56*b*, 56*c* like the first embodiment.

The bracket 155 has an arcuate Y-shaped portion 155*a* like the first embodiment, and a bearing unit 54*a* of the cover member 154 of the rotary encoder 150 is fitted to the arcuate Y-shaped portion 155*a*. The arcuate Y-shaped portion 155*a* is formed integrally with not only a coupling portion 155*b* extending toward the supporting frame 41A in a direction perpendicular to a face of the arcuate Y-shaped portion 155*a* but also claws 155*f*. An accommodation space for enclosing the rotary encoder 150 is defined by the arcuate Y-shaped portion 155*a*, the coupling portion 155*b*, and the claws 155*f*. Three side faces of four side faces of the cover member 154 are clamped by the coupling portion 155*b* and the claws 155*f*, so that the rotary encoder 150 is fixed to the bracket 155. An end of the coupling portion 155*b* on the side of the supporting frame 41A is formed integrally with a first screw portion 155*c* and a second screw portion 155*d* extending in a direction perpendicular to the face of the coupling portion 155*b*, respectively. The first screw portion 155*c* is fixed to the supporting frame 41A by the fixing screw 56*a*, while the second screw portion 155*d* is fixed to the supporting frame 41A by two fixing screws 56*b* and 56*c*.

With the configuration, in the first modification, a front side end of the rotational shaft 19*a* of the secondary transfer inlet roller 19 attached with the rotational disc 51 is rotatably supported such that the rotational disc 51 is sandwiched by the supporting frame 41A, and the base plate 153 and the cover member 154 fixed to the bracket 155 by the supporting frame 41A. Thereby, the front side end of the rotational shaft 19*a* of the secondary transfer inlet roller 19 is supported at three points by the supporting frame 41A, base plate 153, and the cover member 154. Accordingly, even if the secondary transfer inlet roller 19 vibrates due to driving of the intermediate transfer belt 10 or the like, fine swinging of the rotational disc 51 and the sensor 52 in the rotary encoder 150 about their supporting portions to the supporting frame 41A is suppressed, as compared with the case the front side end of the rotational shaft 19*a* is supported at only one point by the supporting frame 41A. As a result, fluctuation of the relative positional relationship between the rotational disc 51 and the sensor 52 due to vibration caused by the swinging is suppressed so that detection error in the sensor 52 is reduced.

The base plate 153 fixed with the sensor 52 and the cover member 154 are fixed to the bracket 155 like the first embodiment, and the bracket 155 is fixed at its three points to the supporting frame 41A by fixing screws 56*a*, 56*b*, 56*c*. Thereby, even if the secondary transfer inlet roller 19 vibrates due to driving of the intermediate transfer belt 10 or the like, vibration due to fine swinging of the base plate 153 and the cover member 154 about fixing potions of the base plate 153 and the cover member 154 to the supporting frame 41A is suppressed, as compared with the case that the base plate 153 and the cover member 154 are fixed to the supporting frame 41A at only one point thereof. As a result, fluctuation of the relative positional relationship between the rotational disc 51 and the sensor 52 due to vibration caused by the swinging is suppressed so that detection error in the sensor 52 is reduced.

According to the first modification, since a detection error in the sensor 52 is reduced, erroneous detection of the rotational angular speed or the rotational angular displacement of the secondary transfer inlet roller 19 can be suppressed, so that accurate feedback control can be made.

In the first modification, mounting can be completed by only fitting the base plate 153 fixed with the sensor 52 and the cover member 154, namely, the rotary encoder 150, to the bracket 155. Thus, an assembling work for the rotary encoder 150 is facilitated.

Figure 9:
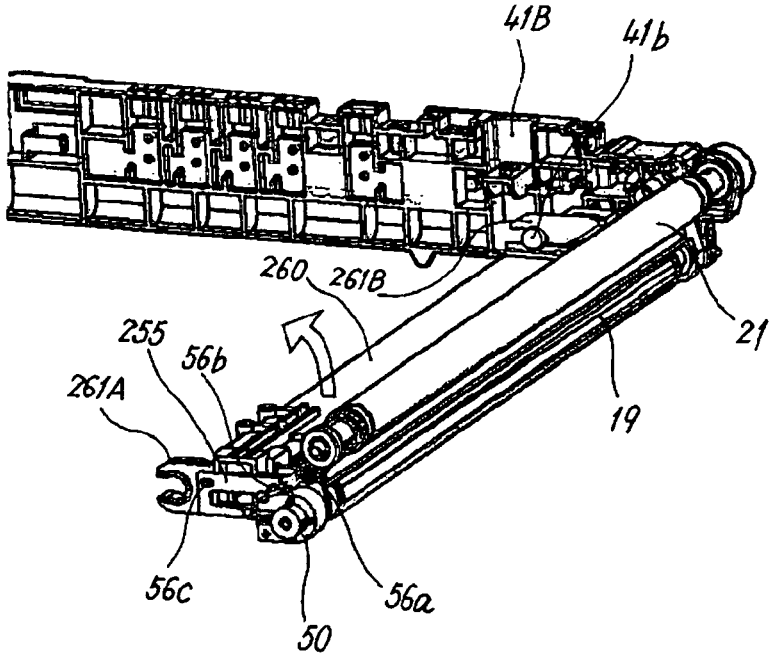
FIG. 9 is a perspective view of a secondary transfer bias roller and a secondary transfer inlet roller according to a second modification of the present invention.

In a second modification, a rotary encoder is fixed to a roller revolving mechanism serving as a positioning and supporting member. FIG. 9 is a perspective view of a secondary transfer bias roller 21 and a secondary transfer inlet roller 19 according to the second modification. In the second modification, the supporting frame 41A on the front side of the printer is not shown for explanation.

Both ends of the rotational shaft 19*a* of the secondary transfer inlet roller 19 are rotatably supported to one end of side frames 261A and 261B of a roller revolution mechanism 260, respectively. The other ends of the side frames 261A and 261B are coupled to revolution shaft portions 41*b*. Thereby, the side frames 261A and 261B are rotatably supported to the supporting frames 41A and 41B about the other ends thereof coupled to the revolution shaft portions 41*b*. That is, the secondary transfer inlet roller 19 can be revolved about the revolution shaft portion 41*b*.

The roller revolution mechanism 260 includes a lock mechanism (not shown). The lock mechanism is for restricting revolving behavior of the roller revolution mechanism 260 to maintain a state of the secondary transfer inlet roller 19 positioned to span the intermediate transfer belt 10. When the intermediate transfer belt 10 is driven, the revolving behavior of the roller revolution mechanism 260 is restricted by the lock mechanism, so that the secondary transfer inlet roller 19 is prevented from revolving and the intermediate transfer belt 10 is kept in its spanned state. On the other hand, when the lock mechanism is unlocked, the roller revolution mechanism 260 is revolved in a direction of arrow in FIG. 9 due to tension of the intermediate transfer belt 10. Thereby, the intermediate transfer belt 10 pushes up the primary transfer bias rollers 11, 12, 13, 14 in a direction in which they separate from the photosensitive drums 1Y, 1C, 1M, and 1K against a biasing force of a biasing unit (not shown) that biases the primary transfer bias rollers 11, 12, 13, 14 toward the photosensitive drums 1Y, 1C, 1M, and 1K. As a result, the surface of the intermediate transfer belt 10 is separated from the photosensitive drums 1Y, 1C, 1M, and 1K. Thereby, when the intermediate transfer unit 40 is inserted into or removed from the printer main unit, the surface of the intermediate transfer belt 10 and the surfaces of the photosensitive drums 1Y, 1C, 1M, and 1K can be prevented from being damaged due to rubbing of the surface of the intermediate transfer belt 10 against the surfaces of the photosensitive drums 1Y, 1C, 1M, and 1K.

In the second modification, the rotary encoder 50 similar to the first embodiment is used, and the rotary encoder 50 is screwed to the side frame 261A of the roller revolution mechanism 260 by a bracket 255. A method for fixing the rotary encoder 50 to the bracket 255 is similar to that in the first embodiment and explanation thereof is omitted. A method for fixing the bracket 255 to the side frame 261A is also similar to the method for fixing the bracket 55 to the supporting frame 41A in the first embodiment, and explanation thereof is omitted.

With the configuration described above, in the second modification, a front side end of the rotational shaft 19*a* of the secondary transfer inlet roller 19 attached with the rotational disc 51 is rotatably supported such that the rotational disc 51 is sandwiched by the side frame 261A of the roller revolution mechanism 260, and the base plate 53 and the cover member 54 fixed to the side frame 261A by the bracket 255. Thereby, the front side end of the rotational shaft 19*a* of the secondary transfer inlet roller 19 is supported at three points by the side frame 261A, the base plate 53, and the cover member 54.

Therefore, even if the secondary transfer inlet roller 19 vibrates due to driving of the intermediate transfer belt 10 or the like, fine swinging of the rotational disc 51 and the sensor 52 in the rotary encoder 50 about their supporting portions to the side frame 261A is suppressed, as compared with the case that the front side end of the rotational shaft 19*a* is supported at only one point by the side frame 261A. As a result, fluctuation of the relative positional relationship between the rotational disc 51 and the sensor 52 due to vibration caused by the swinging is suppressed so that detection error in the sensor 52 is reduced.

The base plate 53 fixed with the sensor 52 and the cover member 54 are fixed to the bracket 255 like the first embodiment, and the bracket 255 is fixed at its three points to the side frame 261A by fixing screws 56*a*, 56*b*, 56*c*. Thereby, even if the secondary transfer inlet roller 19 vibrates due to driving of the intermediate transfer belt 10 or the like, vibration due to fine swinging of the base plate 53 and the cover member 54 about fixing portions of the base plate 53 and the cover member 54 to the side frame 261A is suppressed, as compared with the case that the base plate 53 and the cover member 54 are fixed to the side frame 261A at only one point thereof. As a result, fluctuation of the relative positional relationship between the rotational disc 51 and the sensor 52 due to vibration caused by the swinging is suppressed so that detection error in the sensor 52 is reduced.

According to the second modification, since the detection error in the sensor 52 is reduced, erroneous detection of the rotational angular speed or the rotational angular displacement of the secondary transfer inlet roller 19 can be suppressed, so that accurate feedback control can be made.

Figure 10:
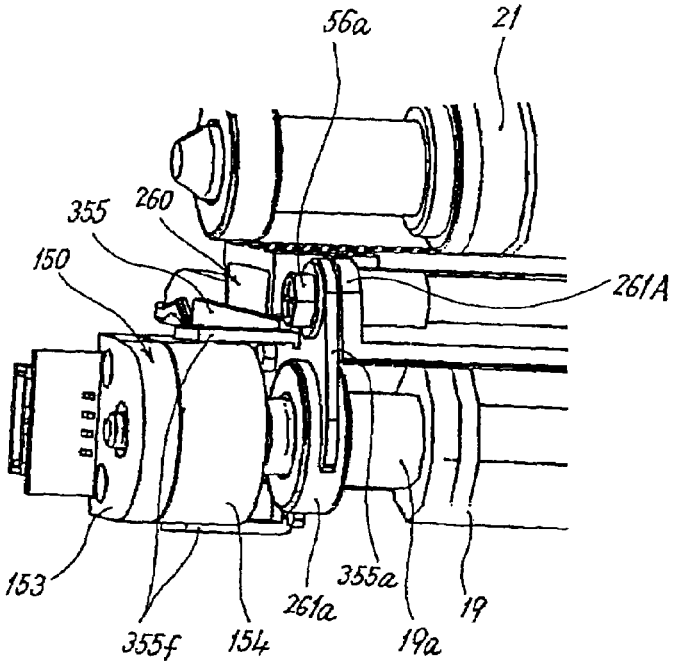
FIG. 10 is an enlarged perspective view of a secondary transfer inlet roller according to a third modification of the present invention.

FIG. 10 is an enlarged perspective view of an end of a secondary transfer inlet roller 19 on a front side of the printer according to a third modification of the detecting mechanism for a rotational angular velocity or a rotational angular displacement of the secondary transfer inlet roller 19. In the third modification, the rotary encoder 150 similar to that in the first modification is used and the rotary encoder 150 is attached to a bracket 355 by fitting the rotary encoder 150 to the bracket 355 like the first modification. The bracket 355 is fixed to the side frame 261A of the roller revolution mechanism 260 at three points by fixing screws 56*a*, 56*b*, 56*c*.

The bracket 355 has a bracket base plate 355*a*, and it is partially formed with an arcuate Y-shaped portion. A bearing unit 261*a* provided on the side frame 261A of the roller revolution mechanism 260 is fitted to the arcuate Y-shaped portion. The bracket base plate 355*a* is formed integrally with a plurality of claws 355*f* extending toward the supporting frame 41A in a direction perpendicular to a face of the bracket base plate 355*a*. An accommodation space for enclosing the rotary encoder 150 is defined by the bracket base plate 355*a* and the claws 355*f*. When the rotary encoder 150 is fitted into the accommodation space, three side faces of four side faces of the cover member 154 is clamped by the claws 355*f*, so that the rotary encoder 150 is fixed to the bracket 355. The bracket base plate 355*a* includes a plurality of screwing portions, and the bracket base plate 355*a* is screwed to the side frame 261A of the roller revolution mechanism 260 by fixing screws 56*a*, 56*b*, 56*c*.

With the configuration described above, in the third modification, a front side end of the rotational shaft 19*a* of the secondary transfer inlet roller 19 attached with the rotational disc 51 is rotatably supported such that the rotational disc 51 is sandwiched by the side frame 261A of the roller revolution mechanism 260, and the base plate 153 and the cover plate 154 fixed to the side frame 261A by the bracket 355. Thereby, the front side end of the rotational shaft 19*a* of the secondary transfer inlet roller 19 is supported at three points by the side frame 261A, the base plate 153, and the cover member 154. Therefore, even if the secondary transfer inlet roller 19 vibrates due to driving of the intermediate transfer belt 10 or the like, fine swinging of the rotational disc 51 and the sensor 52 in the rotary encoder 150 about their supporting portions to the side frame 261A is suppressed, as compared with the case that the front side end of the rotational shaft 19*a* is supported at only one point by the side frame 261A. As a result, fluctuation of the relative positional relationship between the rotational disc 51 and the sensor 52 due to vibration caused by the swinging is suppressed so that detection error in the sensor 52 is reduced.

The base plate 153 fixed with the sensor 52 and the cover member 154 are fixed to the bracket 355 like the first embodiment, and the bracket 355 is fixed at its three points to the side frame 261A by fixing screws 56*a*, 56*b*, 56*c*. Thereby, even if the secondary transfer inlet roller 19 vibrates due to driving of the intermediate transfer belt 10 or the like, vibration due to fine swinging of the base plate 153 and the cover member 154 about fixing portions of the base plate 153 and the cover member 154 to the side frame 261A is suppressed, as compared with the case that the base plate 153 and the cover member 154 are fixed to the side frame 261A at only one point thereof. As a result, fluctuation of the relative positional relationship between the rotational disc 51 and the sensor 52 due to vibration caused by the swinging is suppressed so that detection error in the sensor 52 is reduced.

According to the third modification, since a detection error in the sensor 52 is reduced, erroneous detection of the rotational angular speed or the rotational angular displacement of the secondary transfer inlet roller 19 can be suppressed, so that accurate feedback control can be made.

In the third modification, mounting can be completed by only fitting the base plate 153 fixed with the sensor 52 and the cover member 154, namely, the rotary encoder 150, to the bracket 355. Thus, an assembling work for the rotary encoder 150 is facilitated.

Figure 11:
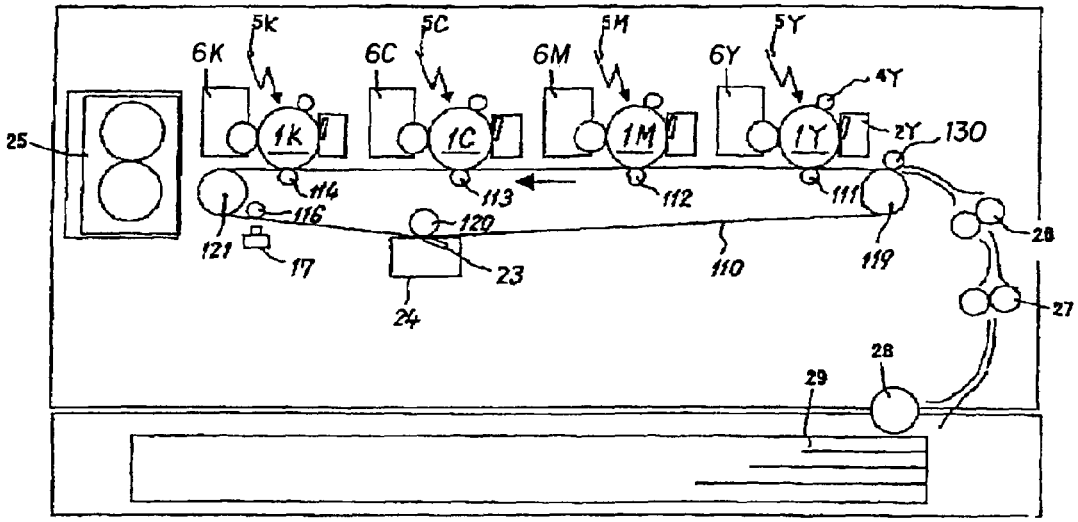
FIG. 11 is a schematic diagram of a printer according to a second embodiment of the present invention.

FIG. 11 is a schematic diagram of a printer serving as an image forming apparatus according to a second embodiment of the present invention. The printer is a tandem type image forming apparatus applying an electrophotographic method. The printer includes four photosensitive drums 1Y, 1C, 1M, and 1K serving as latent image carriers. Explanations about configurations of the tandem image forming unit, of the registration roller 26, paper conveying roller 27, and pickup roller 28, and of the fusing device 25 that are the same configurations as in the first embodiment will be omitted.

The printer has a tandem image forming unit serving as an image forming unit just above a conveying belt 110 serving as a paper conveying member. An exposing device is provided just above the photosensitive drums 1Y, 1C, 1M, and 1K. The conveying belt 110 is spanned around supporting rotational members such as four transfer bias rollers 111, 112, 113, and 114 constituting a transfer unit, a sensor opposing roller 116, an inlet roller 119, an outlet roller 121, and a belt cleaning opposing roller 120. Transfer biases are applied from a high voltage power source (not shown) to the transfer bias rollers 111, 112, 113, and 114. Thereby, transfer is performed in transfer regions between belt portions of the conveying belt 110 wound on the transfer bias rollers 111, 112, 113, 114 and the photosensitive drums 1Y, 1C, 1M, and 1K. Since the respective transfer bias rollers 111, 112, 113, and 114 press the conveying belt 110 to form nips between the conveying belt 110 and the photosensitive drums 1Y, 1C, 1M, and 1K, they have elastic layers.

The recording material 29 fed by the registration roller 26 is fed into a paper charging region between a belt portion of the conveying belt 110 wound around the inlet roller 119 and a paper charging roller 130. The paper charging roller 130 is connected to a power source (not shown) and is applied with a paper charging bias. Thereby, charge required for attraction with the conveying belt 110 is supplied to the recording material 29 which has passed through the paper charging region, and the recording material 29 is carried on an outer peripheral face of the conveying belt 110 stably so that the recording material 29 can be conveyed.

Respective color images on the photosensitive drums 1Y, 1C, 1M, and 1K are sequentially transferred, in the transfer regions, on the recording material 29 conveyed in the transfer regions while being carried on a surface of the conveying belt 110 in a superimposing manner. The recording material 29 transferred with the respective color toner images in the transfer regions is separated from the conveying belt 110 due to a curvature of the outlet roller 121 to be fed to the fusing device 25. The toner image is fused on the recording material 29 by the fusing device 25 and the recording material 29 with the toner image is discharged outside the apparatus.

According to the second embodiment, image formation can be performed in a single color mode, a two color mode, a three color mode, and a full color mode like the first embodiment, and an out-of-color registration correcting control mode and an image density adjusting control mode are included.

Even in such an image forming apparatus of a direct transfer method, it is important to perform drive control on the conveying belt 110 like the drive control on the intermediate transfer belt 10 according to the first embodiment to reduce fluctuation of a surface moving speed of the conveying belt 110 thereby preventing out of color registration from occurring on a recording material 29 carried and conveyed on a surface of the conveying belt 110. Therefore, a rotational shaft of an idle roller (for example, the belt cleaning opposing roller 120) of the supporting rotational bodies spanned with the conveying belt 110 has a detecting mechanism for detecting a rotational angular speed or a rotational angular displacement of the rotational shaft. Since the belt cleaning opposing roller 120 including the rotary encoder vibrates due to driving of the conveying belt 110 or the like, as described above, an erroneous detection occurs in the sensor, so that feedback control on the conveying belt 110 cannot be made accurately. Accordingly, the detecting mechanism explained in the first embodiment is adopted as the detecting mechanism of the second embodiment. A configuration of the detecting mechanism is similar to that in the first embodiment, and explanation thereof is omitted.

In the second embodiment, since the detecting mechanism similar to that in the first embodiment, a detection error in the sensor 52 is reduced. Therefore, erroneous detection of a rotational angular speed or a rotational angular displacement of an idle roller such as the belt cleaning opposing roller 120 spanned with the conveying belt 110 is reduced, so that accurate feedback control can be made.

In the second embodiment, one of the detecting mechanisms explained in the first to the third modifications can be adopted instead of the detecting mechanism in the first embodiment.

Figure 12:
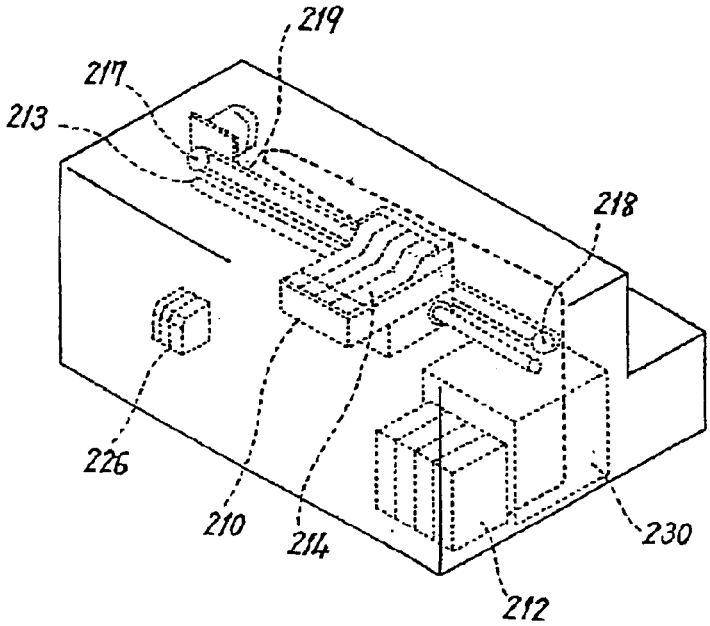
FIG. 12 is a perspective view of an inkjet recording apparatus according to a third embodiment of the present invention.
Figure 13:
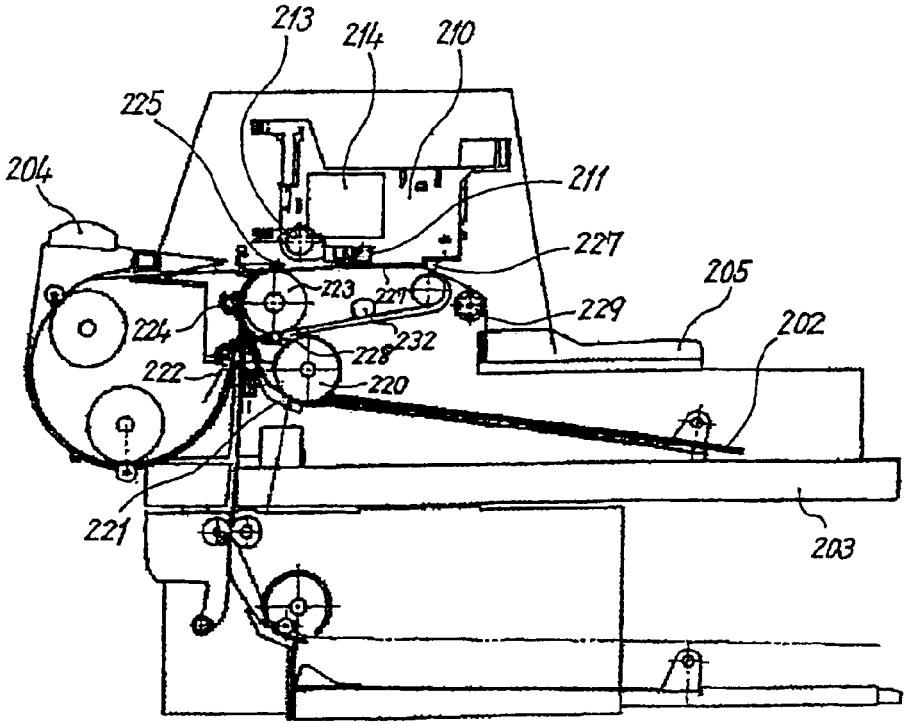
FIG. 13 is a side view of a mechanical unit of the inkjet recording apparatus.

FIG. 12 is a perspective view of an internal configuration of an inkjet recording apparatus serving as an image forming apparatus according to a third embodiment of the present invention. FIG. 13 is a side view of a mechanical unit in the inkjet recording apparatus.

The inkjet recording apparatus has a carriage 210 movable in a main scanning direction inside an apparatus main unit. Recording heads 211 are attached to the carriage 210. Ink cartridges 212 supplying inks to the recording heads 211 are accommodated inside the apparatus main unit. A paper feed cassette 203 on which a plurality of recording materials 202 can be stacked is equipped in a lower portion of the apparatus main unit so as to be insertable into and removable from a front side of the apparatus main unit. A manual feed tray 204 for feeding a recording material 202 manually is foldably attached on the apparatus main unit. The inkjet recording apparatus takes in the recording material 202 fed from the paper feed cassette 203 or the manual feed tray 204, and discharges the recording material to a paper discharge tray 205 provided on the back side of the apparatus main unit after the recording heads 211 on the carriage 210 forms an image on the recording material.

A printing mechanism unit includes the carriage 210 and the ink cartridge 212. The printing mechanism unit holds the carriage 210 to be slidable in a main scanning direction using a main guide rod 213 serving as a guide member bridged between left and right side plates (not shown). The carriage 210 is held by the main guide rod 213 such that respective color inks of yellow (Y), cyan (C), magenta (M), and black (Bk) ejected from the recording heads 211 are directed downwardly. Sub-ink tanks 214 for supplying respective color inks to the recording heads 211 are provided at an upper portion of the carriage 210. The respective color ink sub-tanks 214 are connected to the ink cartridges 212 exchangeably attached, and they are supplied with inks from the ink cartridges 212. The carriage 210 is slidably fitted to the main guide rod 213 at the back side thereof. To move and scan the carriage 210 in the main scanning direction, a timing belt 219 is spanned between a driving pulley 217 and an idle pulley 218 and the timing belt 219 is fixed to the carriage 210.

In the third embodiment, the recording heads 211 include individual recording heads 211 corresponding to respective colors. However, one recording head 211 including having nozzles that eject respective color ink drops can be used. As the recording head 211, one of a piezoelectric type where ink is pressurized by an electromechanical transducer such as a piezoelectric device via a vibrating plate forming a wall face of a liquid chamber (an ink flow path), one of a bubble type where bubbles are generated by a film boiling due to a heat generating resistor to pressurize ink, or one of an electrostatic type where a vibrating plate forming an ink flow path wall face is displaced by an electrostatic force between the vibrating plate and an electrode opposed thereto to pressurize ink, or the like can be used. In the third embodiment, the electrostatic type inkjet head is used.

The inkjet recording apparatus conveys the recording material 202 set in the paper feed cassette 203 below the recording head 211 using a paper feed roller 220 and a friction pad 221 that separate a recording material 202 from a sheet of paper stack on the paper feed cassette 203 to feed the same, a guide member 222 that guides the recording material 202, a conveying belt 227 that reverses the fed recording material 202 to convey the same, a conveying roll 224 that is pressed on a peripheral face of the conveying belt 227, and a distal end roll 225 regulating a feeding angle of the recording material 202 conveyed by the conveying belt 227. A driving roller 223 spanned with the conveying belt 227 is rotationally driven by a sub-scanning motor 226 via a gear train (not shown).

The conveying belt 227 is charged using a charger 228 to attract the recording material 202 conveyed so that a face of a sheet and a head face can be kept in parallel with each other. A paper discharge roll 229 for feeding out the recording material 202 to the paper discharge tray 205 is disposed on a downstream side in a paper conveying direction of the conveying belt 227. A maintenance and recovery mechanism 230 for maintaining and recovering reliability of the recording head 211 is disposed at one end of the carriage 210 in a moving direction thereof. The carriage 210 is positioned at the maintenance and recovery mechanism 230, and the recording head 211 is capped by a capping unit in a printing standby time.

In the image forming apparatus of the inkjet type, it is important to perform drive control on the conveying belt 227 to reduce fluctuation of a surface moving speed of the conveying belt 227 like the drive control on the conveying belt 110 according to the second embodiment. This is because, when the surface moving speed of the conveying belt 227 fluctuates, ink cannot be accurately dropped on a target position on a recording material 202 carried and conveyed on the surface of the conveying belt 227, which results in deterioration of image quality. Therefore, a rotational shaft of an idle roller 232 of the supporting rotational bodies spanned with the conveying belt 227 has a detecting mechanism for detecting a rotational angular speed or a rotational angular displacement of the rotational shaft. Since the idle roller 232 including the rotary encoder vibrates due to driving of the conveying belt 227 or the like, as described above, an erroneous detection occurs in the sensor, so that feedback control on the conveying belt 227 cannot be made accurately. Accordingly, the detecting mechanism explained in the first embodiment is adopted as the detecting mechanism according to the third embodiment. The configuration of the detecting mechanism is similar to that in the first embodiment, and explanation thereof is omitted.

In the third embodiment, since the detecting mechanism is similar to that in the first embodiment, a detection error in the sensor 52 is reduced. Therefore, erroneous detection of a rotational angular speed or a rotational angular displacement of the idle roller 232 spanned with the conveying belt 227 is reduced, so that accurate feedback control can be made.

In the third embodiment, one of the detecting mechanisms explained in the first to the third modifications can be adopted instead of the detecting mechanism in the first embodiment.

The belt devices according to the first to the third embodiments (including the first modification) include the intermediate transfer belt 10 or the conveying belt 110 or 227 which is the annular belt spanned around at least two supporting rotational members, the supporting frames 41A and 41B that rotatably support the supporting rotational members, the rotational disc 51 that is attached to one end of the rotational shaft 19*a*, serving as the rotational member, which is one of the supporting rotational members and that is rotated integrally with the rotational shaft 19*a* such that the slits constituting the plurality of marks are moved on a fixed orbit, and the sensor 52, serving as the mark detector, which detects the slits in the rotational disc 51 passing through a specific point on the orbit. The sensor 52 is fixed to the base plate 53 or 153, the cover member 54 or 154, and the bracket 55 or 155 serving as the fixing members fixed at, at least two points to the supporting frame 41A, and the one end of the rotational shaft 19*a* of the roller 19, 120, or 232 attached with the rotational disc 51 is rotatably supported such that the rotational disc 51 is sandwiched by the supporting frame 41A and the fixing members. Thereby, as described above, since a detection error in the sensor 52 is reduced, erroneous detection of the rotational angular speed or the rotational angular displacement of the roller 19, 120, 232 is suppressed so that accurate feedback control can be made.

The belt devices according to the second and the third modifications include the intermediate transfer belt 10 or the conveying belt 110 or 227 which is the annular belt spanned around at least two supporting rotational members, the supporting frames 41A and 41B that rotatably support some of the supporting rotational members, the rotational disc 51, serving as the rotational member, which is attached to one end of the rotational shaft 19*a* of the secondary transfer inlet roller 19 that is not rotatably supported by the supporting frames 41A and 41B and that rotates integrally with the rotational shaft 19*a* so that slits which are a plurality of marks move on a fixed orbit, and the sensor 52, serving as the mark detector, which detects the slits of the rotational disc 51 passing through a specific point on the fixed orbit. The belt device also includes the roller revolution mechanism 260, serving as the positioning supporting member, which rotatably supports the secondary transfer inlet roller 19 attached with the rotational disc 51 and positions the secondary transfer inlet roller 19 to be switchable between the position where the intermediate transfer belt 10 is spanned and the position where the tension of the intermediate transfer belt 10 is cancelled. The roller revolution mechanism 260 is supported by the supporting frames 41A and 41B, the sensor 52 is fixed to the base plate 53 or 153, the cover member 54 or 154, and the bracket 255 or 355, serving as the fixing members, which are fixed at, at least two points to the roller revolution mechanism 260, and the one end of the rotational shaft 19*a* of the secondary transfer inlet roller 19 attached with the rotational disc 51 is rotatably supported such that the rotational disc 51 is sandwiched by the roller revolution mechanism 260 and the fixing members. Thereby, as described above, since detection error in the sensor 52 is reduced, erroneous detection of the rotational angular speed or the rotational angular displacement of the secondary transfer inlet roller 19 is suppressed so that accurate feedback control can be made.

In the first to the third embodiments (including the first to the third modifications), since the rotational disc 51 and the rotational shaft 19*a* are formed integrally, there is no backlash between the rotational disc 51 and the rotational shaft 19*a*. Accordingly, erroneous detection by the sensor 52 is further suppressed, so that more accurate feedback control can be made.

In the first to the third embodiments (including the first to the third modifications), the supporting frame 41A rotatably supports the rotational shaft 19*a* of the roller 19, 120, or 232 attached with the rotational disc 51 in the axial direction of the roller 19, 120, or 232 outside the supporting frame 41A. Thereby, the rotary encoder 50 or 150 is positioned inside the supporting frame 41A. When the supporting frame 41A rotatably supports the rotational shaft 19*a* of the roller 19, 120, or 232 to the fixing members in the axial direction of the roller 19, 120, or 232 outside the supporting frame 41A, the rotary encoder 50 or 150 is positioned outside the supporting frame 41A, so that a user becomes easily contactable with the rotary encoder 50 or 150. Since the rotary encoder 50 or 150 is a precision device, it is desirable that user's contact thereon should be avoided. When the rotary encoder 50 or 150 is positioned inside the supporting frame 41A like the first to the third embodiments, contact on the rotary encoder 50 or 150 can be suppressed.

In the first to the third embodiments (including the first to the third modifications), the base plate 53, 153 and the cover member 54, 154 are provided as a cover member accommodated inside the rotational disc 51 and the sensor 52, the sensor 52 is fixed on an inner wall of the cover member 54, 154, and the cover member 54, 154, is fixed on two or more points, together with the base plate 53, 153, on the to the supporting frame 41A or the roller revolution mechanism 260 by the bracket 55, 155, 255, 355 as a fitting member. With this arrangement, a fixing work of the supporting frame 41A or the roller revolution mechanism 260 of the supporting frame 41A can be made easier.

In the first to the third embodiments (including the first to the third modifications), the bearing unit 53*a*, 54*a* rotatably bearing the rotational shaft 19*a* of the roller 19, 120, or 232 attached with the rotational disc 51 in the base plate 53 or 153 and the cover member 54 or 154, so that the internal space is closed by the base plate 53 or 153 and the cover member 54 or 154. Thereby, dust and dirt are prevented from entering in the internal space, so that erroneous detection is prevented from occurring due to adhesion of dust and dirt to the sensor 52 accommodated in the internal space.

In the first to the third embodiments (including the second modification), the base plate 53 is fixed to the bracket 55 or 255 by the fixing screw 56*a*. Thereby, fixation of the rotary encoder 50 to the bracket 55 or 255 is made firm, backlash is reduced, and erroneous detection is suppressed in the sensor 52, so that more accurate feedback control can be made.

Particularly, in the first to the third embodiments (including the second modification), the base plate 53 is fixed, together with the bracket 55 or 255, to the supporting frame 41A or the roller revolution mechanism 260 by the fixing screw 56*a*. Thereby, fixation of the rotary encoder 50 to the bracket 55 or 256 and fixation of the bracket 55 or 255 to the supporting frame 41A or the roller revolution mechanism 260 can be performed simultaneously, so that high efficiency of an assembling work can be achieved.

In the first to the third embodiments (including the second modification), the base plate 53 is fixed to the bracket 55 or 255 at plural portions, and one of the portions is fixed by causing the hook portion 55*e*, serving as the to-be-engaged portion, which is provided on the bracket 55 or 255 and the projection, serving as the engaging portion, that the base plate 53 to engage with each other, and the remaining portions are fixed by the fixing screw 56*a*. Thereby, when the rotary encoder 50 is attached to the bracket 55 or 255, and the projection on the base plate 53 is caused to engage with the hook portion 55*e* of the bracket 55 or 255 so that the rotary encoder 50 can be temporarily held to the bracket 55 or 255. As a result, screwing work can be performed without retaining the rotary encoder 50 so as not to move at a screwing work time where the bracket 55 or 255 is screwed to the supporting frame 41A or the roller revolution mechanism 260, so that the screwing work can be facilitated.

In the first and the third modifications, the cover member 54 or 154 is fixed to the bracket 155 or 355 by fitting the cover member 54 or 154 into the accommodation space provided in the bracket 155 or 355. Thereby, as described above, assembling of the rotary encoder 150 is made easy.

In the first embodiment (including the first to the third modifications), since the belt is the intermediate transfer belt 10, serving as the image carrier, which carries an image on an outer peripheral face thereof, accurate driving control of the intermediate transfer belt 10 can be made possible.

In the second and the third embodiments, since the belt is the conveying belt 110 or 227, serving as the paper conveying members, which carries the recording material 29 or 202 which is a sheet of paper on the outer peripheral face and conveys the same, accurate driving control on the conveying belt 110 or 227 can be made possible so that the recording material 29 or 202 can be conveyed at a desired speed.

The present invention can be not only applied to the belt device for the image forming apparatus but also applied to any belt device including an annular belt that requires accurate driving control preferably.

According to the embodiments described above, it is possible to suppress error detection when a rotational angular speed or a rotational angular displacement of a supporting rotational member is detected using detection results obtained from the mark detector.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device comprising:

an annular belt spanned around at least two supporting rotational bodies;

a supporting frame configured to rotatably support the supporting rotational bodies;

a rotational member attached to one end of a rotational shaft of one of the supporting rotational bodies, having a plurality of marks arranged thereon, and configured to rotate integrally with the rotational shaft such that the marks are moved on a fixed orbit;

a mark detector configured to detect the marks at a predetermined point on the fixed orbit; and a fixing member fixed to the supporting frame at, at least two points, wherein the mark detector is fixed to the fixing member, and the rotational member is rotatably supported at the one end with the supporting frame and the fixing member such that the rotational member is sandwiched between the supporting frame and the fixing member.

2. The belt device according to claim 1, wherein the rotational member is formed integrally with the rotational shaft.

3. The belt device according to claim 1, wherein the supporting frame is configured to rotatably support the supporting rotational body, to which the rotational member is attached, at an outer position with respect to the fixing member in a direction of an axis of the supporting rotational body.

4. The belt device according to claim 1, wherein the fixing member includes a case member configured to accommodate the rotational member and the mark detector therein; and a mounting member, wherein the mark detector is fixed to an inner wall of the case member, and the case member is fixed to the supporting frame at, at least two portions by the mounting member.

5. The belt device according to claim 4, wherein the case member includes a bearing unit configured to rotatably bear the rotational shaft of the supporting rotational body to which the rotational member is attached, and is configured to close an internal space of the case member.

6. The belt device according to claim 4, wherein the case member is fixed to the mounting member with screws.

7. The belt device according to claim 4, wherein the case member and the mounting member are fixed to the supporting frame or a positioning supporting member together with a common screw.

8. The belt device according to claim 4, wherein the case member is fixed to the mounting member at a plurality of portions, and one of the portions is fixed by causing an engaging portion provided on the mounting member and an engaging portion provided on the case member to engage with each other, and others of the portions are fixed with a screw.

9. The belt device according to claim 4, wherein the mounting member and the case member are fixed to each other by fitting the case member into a fitting portion provided in the mounting member.

10. The belt device according to claim 1, wherein the annular belt is an image carrier configured to carry an image on an outer peripheral face thereof.

11. The belt device according to claim 1, wherein the annular belt is a paper conveying member configured to carry paper on an outer peripheral face thereof.

12. A belt device that is attachable to and detachable from an apparatus, comprising:

an annular belt spanned around at least two supporting rotational bodies;

a supporting frame configured to rotatably support one of the supporting rotational bodies;

a rotational member attached to one end of a rotational shaft of another of the supporting rotational bodies that is not supported by the supporting frame, the rotational member having a plurality of marks arranged thereon, and configured to rotate integrally with the rotational shaft such that the marks are moved on an orbit;

a mark detector configured to detect the marks;

a positioning supporting member configured to rotatably support the other of the supporting rotational bodies, and to switch a position of the other of the supporting rotational bodies between a position for applying tension to the annular belt, and a position for removing the tension from the annular belt; and a fixing member fixed to the positioning supporting member at, at least two portions, wherein the positioning supporting member is supported by the supporting frame, the mark detector is fixed to the fixing member, and the other of the supporting rotational bodies is rotatably supported at the one end with the positioning supporting member and the fixing member such that the rotational member is sandwiched between the positioning supporting member and the fixing member.

13. The belt device according to claim 12, wherein the rotational member is formed integrally with the rotational shaft.

14. The belt device according to claim 12, wherein the supporting frame is configured to rotatably support the supporting rotational body, to which the rotational member is attached, at an outer position with respect to the fixing member in a direction of an axis of the supporting rotational body.

15. The belt device according to claim 12, wherein the fixing member includes a case member configured to accommodate the rotational member and the mark detector therein; and a mounting member, wherein the mark detector is fixed to an inner wall of the case member, and the case member is fixed to any one of the supporting frame and the positioning supporting member at, at least two portions by the mounting member.

16. The belt device according to claim 15, wherein the case member includes a bearing unit configured to rotatably bear the rotational shaft of the supporting rotational body to which the rotational member is attached, and is configured to close an internal space of the case member.

17. The belt device according to claim 15, wherein the case member is fixed to the mounting member with screws.

18. The belt device according to claim 15, wherein the case member and the mounting member are fixed to any one of the supporting frame and the positioning supporting member together with a common screw.

19. The belt device according to claim 15, wherein the case member is fixed to the mounting member at a plurality of portions, and one of the portions is fixed by causing an engaging portion provided on the mounting member and an engaging portion provided on the case member to engage with each other, and others of the portions are fixed with a screw.

20. The belt device according to claim 15, wherein the mounting member and the case member are fixed to each other by fitting the case member into a fitting portion provided in the mounting member.

21. The belt device according to claim 12, wherein the annular belt is an image carrier configured to carry an image on an outer peripheral face thereof.

22. The belt device according to claim 12, wherein the annular belt is a paper conveying member configured to carry paper on an outer peripheral face thereof.

23. An image forming apparatus comprising:

a belt device including an annular belt spanned around at least two supporting rotational bodies;

a supporting frame configured to rotatably support the supporting rotational bodies;

a rotational member attached to one end of a rotational shaft of one of the supporting rotational bodies, having a plurality of marks arranged thereon, and configured to rotate integrally with the rotational shaft such that the marks are moved on a fixed orbit;

a mark detector configured to detect the marks at a predetermined point on the fixed orbit; and a fixing member fixed to the supporting frame at, at least two points, wherein the mark detector is fixed to the fixing member, and the rotational member is rotatably supported at the one end with the supporting frame and the fixing member such that the rotational member is sandwiched between the supporting frame and the fixing member;

a controller configured to control a surface moving speed of the annular belt based on a result of detection by the mark detector; and an image forming unit configured to form an image on the annular belt.

24. An image forming apparatus comprising:

a belt device including;

an annular belt spanned around at least two supporting rotational bodies;

a supporting frame configured to rotatably support one of the supporting rotational bodies;

a rotational member attached to one end of a rotational shaft of another of the supporting rotational bodies that is not supported by the supporting frame, the rotational member having a plurality of marks arranged thereon, and configured to rotate integrally with the rotational shaft such that the marks are moved on an orbit;

a mark detector configured to detect the marks;

a positioning supporting member configured to rotatably support the other of the supporting rotational bodies, and to switch a position of the other of the supporting rotational bodies between a position for applying tension to the annular belt, and a position for removing the tension from the annular belt; and a fixing member fixed to the positioning supporting member at, at least two portions, wherein the positioning supporting member is supported by the supporting frame, the mark detector is fixed to the fixing member, and the other of the supporting rotational bodies is rotatably supported at the one end with the positioning supporting member and the fixing member such that the rotational member is sandwiched between the positioning supporting member and the fixing member;

a controller configured to control a surface moving speed of the annular belt based on a result of detection by the mark detector; and an image forming unit configured to form an image on the annular belt.

25. An image forming apparatus comprising:

a belt device including an annular belt spanned around at least two supporting rotational bodies and configured to convey a transfer sheet;

a supporting frame configured to rotatably support the supporting rotational bodies;

a rotational member attached to one end of a rotational shaft of one of the supporting rotational bodies, having a plurality of marks arranged thereon, and configured to rotate integrally with the rotational shaft such that the marks are moved on a fixed orbit;

a mark detector configured to detect the marks at a predetermined point on the fixed orbit; and a fixing member fixed to the supporting frame at, at least two points, wherein the mark detector is fixed to the fixing member, and the rotational member is rotatably supported at the one end with the supporting frame and the fixing member such that the rotational member is sandwiched between the supporting frame and the fixing member;

a controller configured to control a surface moving speed of the annular belt based on a result of detection by the mark detector; and an image forming unit configured to form an image on the transfer sheet conveyed by the annular belt.

26. An image forming apparatus comprising:

a belt device including an annular belt spanned around at least two supporting rotational bodies and configured to convey a transfer sheet;

a supporting frame configured to rotatably support one of the supporting rotational bodies;

a rotational member attached to one end of a rotational shaft of another of the supporting rotational bodies that is not supported by the supporting frame, the rotational member having a plurality of marks arranged thereon, and configured to rotate integrally with the rotational shaft such that the marks are moved on an orbit;

a mark detector configured to detect the marks;

a positioning supporting member configured to rotatably support the other of the supporting rotational bodies, and to switch a position of the other of the supporting rotational bodies between a position for applying tension to the annular belt, and a position for removing the tension from the annular belt; and a fixing member fixed to the positioning supporting member at, at least two portions, wherein the positioning supporting member is supported by the supporting frame, the mark detector is fixed to the fixing member, and the other of the supporting rotational bodies is rotatably supported at the one end with the positioning supporting member and the fixing member such that the rotational member is sandwiched between the positioning supporting member and the fixing member;

a controller configured to control a surface moving speed of the annular belt based on a result of detection by the mark detector; and an image forming unit configured to form an image on the transfer sheet conveyed by the annular belt.

* * * * *